US008240241B2

(12) United States Patent
Batenburg

(10) Patent No.: US 8,240,241 B2
(45) Date of Patent: Aug. 14, 2012

(54) HYDRAULIC DRIVE SYSTEM AND DIAGNOSTIC CONTROL STRATEGY FOR IMPROVED OPERATION

(75) Inventor: Greg Batenburg, Delta (CA)

(73) Assignee: Westport Power, Inc., Vancouver, BC (CA)

( * ) Notice: Subject to any disclaimer, the term of this patent is extended or adjusted under 35 U.S.C. 154(b) by 153 days.

(21) Appl. No.: 12/753,822

(22) Filed: Apr. 2, 2010

(65) Prior Publication Data

US 2010/0212306 A1 Aug. 26, 2010

Related U.S. Application Data

(63) Continuation of application No. PCT/CA2008/001772, filed on Oct. 3, 2008.

(51) Int. Cl.
*F01L 25/08* (2006.01)
*F15B 11/10* (2006.01)
*F04B 49/02* (2006.01)

(52) U.S. Cl. ..... 91/275; 91/433; 62/49.2; 417/211.5

(58) Field of Classification Search ..... 62/49.2, 62/50.6; 91/275, 401, 433; 417/211.5
See application file for complete search history.

(56) References Cited

U.S. PATENT DOCUMENTS 4,177,017 A 12/1979 Schultz

FOREIGN PATENT DOCUMENTS

| | | |
|---|---|---|
| CA | 2476032 | 8/2004 |
| CA | 2523732 | 11/2005 |
| CA | 2527122 | 12/2005 |
| CA | 2527563 | 12/2005 |
| CN | 101078395 | 11/2007 |

*Primary Examiner* — Daniel Lopez
(74) *Attorney, Agent, or Firm* — Corridor Law Group, P.C.

(57) ABSTRACT

A method and apparatus are provided for hydraulic fluid supply between a hydraulic pump and a hydraulic drive unit, switching hydraulic fluid flow direction to the hydraulic drive unit or stopping hydraulic fluid flow to the hydraulic drive unit when measured hydraulic fluid pressure crosses a predetermined pressure threshold value. The method further comprises calculating an amount of mechanical work done by the hydraulic drive unit and warning an operator or limiting hydraulic fluid flow rate to the hydraulic drive unit when the calculated mechanical work for the drive cycle is less than an expected amount of mechanical work. The apparatus for practicing the method further includes a pressure sensor associated with a hydraulic fluid supply conduit between the pump and the drive unit, and an electronic controller programmed to operate the drive system according to the method.

29 Claims, 9 Drawing Sheets

HYDRAULIC DRIVE SYSTEM AND DIAGNOSTIC CONTROL STRATEGY FOR IMPROVED OPERATION

CROSS-REFERENCE TO RELATED APPLICATION(S)

This application is a continuation of International Application No. PCT/CA2008/001772, having an international filing date of Oct. 3, 2008, entitled "Hydraulic Drive System And Diagnostic Control Strategy For Improved Operation". The '772 international application claimed priority benefits, in turn, from Canadian Patent Application No. 2,602,164 filed Oct. 4, 2007. The '772 international application is hereby incorporated by reference herein in its entirety.

FIELD OF THE INVENTION

The present invention relates to a hydraulic drive system and a diagnostic control strategy for improved operation. While many hydraulic drive-systems can benefit from the disclosed system and control strategy, it is particularly advantageous for systems that use a hydraulic fluid pump that is operated at different speeds, for example, such systems that have a hydraulic fluid pump that is mechanically driven by an engine, wherein hydraulic pump speed is proportional to engine speed, because it can be more challenging to control such systems compared to systems with a hydraulic fluid pump that operates at a constant speed. In addition, some aspects of the disclosed system are particularly suited to hydraulic drive systems that are employed to produce reciprocating motion, which requires hydraulic fluid flow switching to reverse the direction of a hydraulic piston in a hydraulic drive unit.

BACKGROUND OF THE INVENTION

Hydraulic drive systems can be employed to provide mechanical power to drive machinery such as a positive displacement pump with a reciprocating piston, and other machinery that uses hydraulic fluid pressure to drive mechanical movements. In such hydraulic drive systems, hydraulic fluid pressure can be measured to provide an indicator of an operational condition, and such indicators can be used to control the hydraulic drive system. For example, co-owned Canadian patent no. 2,527,122, entitled, "Apparatus and Method for Pumping a Fluid From a Storage Vessel and Detecting When the Storage Vessel is Empty" (the '122 patent) discloses an apparatus comprising a hydraulically driven reciprocating piston pump that pumps a process fluid from a storage tank and a method comprising measuring hydraulic fluid pressure to determine when the storage tank is empty. For process fluids such as cryogenic fluids, commercially practical level sensors are not yet available, so such a method of determining when the storage tank is empty and preventing the pump from operating when the storage tank is empty is useful. The method taught by the '122 patent comprises measuring peak hydraulic system pressure and determining that the storage tank is empty when peak hydraulic system pressure falls below a predetermined threshold value for a predetermined number of times, indicating that the pump is encountering less process fluid resistance during the pumping stroke. When the storage tank is determined to be empty, the electronic controller for the hydraulic system can be programmed to switch to pumping process fluid from a different storage tank. While this method works, a challenge associated with this approach is that peak hydraulic system pressure can change responsive to factors other than the amount of process fluid being pumped. For example, peak hydraulic system pressure can also change responsive to the pressure of the process fluid in the system to which it is being pumped, since downstream process fluid pressure correlates to the resistance against the pump piston during a discharge stroke. Resistance to pump piston movement can also be a function of kinetic friction, whereby changes in hydraulic fluid flow rate, caused by changes in the speed of a hydraulic pump that delivers the hydraulic fluid to the hydraulic drive, can also influence peak hydraulic system pressure in the hydraulic drive. Accordingly, the method taught by the '122 patent, which relies upon a measurement of peak hydraulic system pressure, can be improved if the expected peak hydraulic system pressure is adjusted to account for other factors that affect the peak hydraulic system pressure, such as process fluid pressure and hydraulic drive speed. The utility of this method is not confined to hydraulically driven pumps. For different hydraulically driven apparatuses, such as, for example, a hydraulic press or an extruder, if peak hydraulic system pressure is less than expected, this can be an indication that there is a smaller than expected quantity of the material that is being worked on, indicating that the supplied material needs to be replenished or that it is time to stop the machinery; here too, peak hydraulic pressure can be variable as a function of normal operating variables such as hydraulic pump speed or hydraulic fluid flow rate.

Referring still to the example of a hydraulically driven reciprocating pump, the efficiency of the pump can be improved by preventing the pump piston from short stroking, which occurs if the pump piston does not extend or retract fully, resulting in an incomplete piston stroke. This is a problem for both single-acting and double-acting piston pumps, because a short stroke prevents the pump piston chamber from being fully charged with process fluid and/or from fully discharging the process fluid. Conventional hydraulic drives can use magnetic proximity sensors to detect when the piston has reached the end of a piston stroke, but this approach adds to the cost and maintenance required since two sensors are required for each hydraulic drive piston. Another approach is to use a flow meter to measure the hydraulic fluid flow and calculate when the hydraulic piston has reached the end of its stroke based on the known volume of the hydraulic cylinder. However, with this approach, the flow meter can be expensive and inaccuracies can be introduced by other factors, such as the accuracy of the flow meter or if hydraulic fluid leakage in the system. Co-owned Canadian patent application 2,476,032, entitled, "Hydraulic Drive System and Method of Operating a Hydraulic Drive System" (the '032 application) discloses a method of preventing short stroking by using a shuttle valve disposed in the hydraulic piston that allows hydraulic fluid to flow through the piston at the end of each piston stroke. This allows the hydraulic piston to complete each stroke without being driven into and damaging the end plates, which permits a controller to be programmed to estimate when the piston has reached the end of a stroke based on at least one of hydraulic pump speed, hydraulic fluid pressure, or elapsed time. The operation of the shuttle valve allows the controller some leeway to ensure that the hydraulic piston stroke is completed before it sends an electronic signal to a flow switching device to switch hydraulic fluid flow direction and the direction of hydraulic piston movement.

FIG. 1 is a graph that plots hydraulic system pressure and pumping state against time for a hydraulic drive system with the hydraulic fluid pump operated with a constant speed. The hydraulic system pressure plotted by line 101 is measured by a sensor associated with a conduit that connects the discharge outlet from a hydraulic pump to a hydraulic drive unit. In this example, the hydraulic drive unit comprises a reciprocating hydraulic piston and the pumping state plotted by line 105 shows whether a piston in the hydraulic drive unit is extending or retracting. A value of 1 for the pumping state indicates that the hydraulic piston is extending and doing work as shown by the correlation with the peak hydraulic system pressure. A value of 2 for the pumping state indicates that the hydraulic piston is retracting, and in this example the pump driven by the hydraulic drive unit is a single-acting pump so the hydraulic system pressure during the retracting stroke is much lower. The plotted data relates to a hydraulic drive unit that is driving a single-acting positive displacement piston pump, that pumps a process fluid from the pump cylinder during the extend stroke, and draws process fluid into the pump cylinder during the retract stroke. Accordingly, during each pump cycle, hydraulic system pressure peaks during the extend stroke, and declines sharply at the end of the piston stroke when the shuttle valve opens. While the shuttle valve is open, hydraulic system pressure levels off at a pressure governed by the pressure drop through the shuttle valve and fluid passage through the piston, as shown by the flat portion of the plot identified by reference number 101B at the end of the extension stroke. In the data plotted for FIG. 1, when the hydraulic piston reverses direction for a retracting stroke, the shuttle valve closes and hydraulic system pressure declines and levels off at an even lower pressure associated with the pressure drop of the hydraulic fluid flowing through an outlet from the cylinder as the hydraulic fluid is drained therefrom. At the end of the retracting stroke, hydraulic system pressure rises to again reflect the pressure drop through the open shuttle and the fluid passage through the piston, as shown by the flat portions of the plot identified by reference numbers 101A and 101A'.

The '032 application teaches a method that eliminates the need for a position or proximity sensor for the hydraulic piston, by programming an electronic controller to estimate when each piston stoke is completed as a function of hydraulic pump speed, hydraulic fluid pressure, or elapsed time. That is, because the displaced hydraulic fluid volume for each piston stroke is known, one of these variables can be used to estimate when each piston stroke is completed by calculating when the piston stroke is expected to be completed from hydraulic pump speed, hydraulic fluid pressure, or elapsed time. The '032 application teaches that the use of the shuttle valve prevents the hydraulic piston from being driven against and damaging the piston or end plates, permitting the controller to use a crude estimate of the timing for the end of the piston stroke and allowing the estimated stroke duration to include extra time for each stroke to prevent short-stroking, ensuring that the hydraulic piston completes its stroke. While this method and apparatus is effective and eliminates the need for sensors to detect when the piston has reached the end of each piston stroke, it can be improved and the hydraulic drive can be made more efficient if the extra time when the shuttle valve is open between hydraulic piston strokes can be reduced.

A number of difficulties associated with a hydraulically driven apparatus have been described above, demonstrating a need for an improved diagnostic control strategy that can be useful for addressing these and other difficulties to improve efficiency and/or operation.

SUMMARY OF THE INVENTION

A method of diagnosing and controlling a hydraulic drive system is disclosed which comprises measuring hydraulic fluid pressure in a hydraulic fluid supply conduit between a hydraulic pump and a hydraulic drive unit; switching hydraulic fluid flow direction to the hydraulic drive unit or stopping hydraulic fluid flow to the hydraulic drive unit to end a drive cycle when measured hydraulic fluid pressure crosses a predetermined pressure threshold value; and adjusting the predetermined pressure threshold value to a corrected pressure threshold value as a function of at least one of: (i) measured resistance transmitted to the hydraulic drive unit from machinery that is coupled to and driven by the hydraulic drive unit; and (ii) hydraulic pump speed; calculating an amount of mechanical work done by the hydraulic drive unit in the drive cycle as a function of the measured hydraulic fluid pressure and at least one of hydraulic pump speed during the drive cycle, time to complete the drive cycle, and the volume displaced by a hydraulic piston in the hydraulic drive unit during the drive cycle; and warning an operator or limiting hydraulic fluid flow rate to the hydraulic drive unit when the calculated mechanical work for the drive cycle is less than an expected amount of mechanical work by a predetermined margin, the expected amount of mechanical work being calculated as function of an expected peak hydraulic system pressure.

In preferred embodiments the amount of mechanical work done by the hydraulic drive unit is calculated by determining an area under a plot of measured hydraulic fluid pressure against volume displaced by a hydraulic piston in the hydraulic drive unit. The method can further comprise correcting the expected amount of mechanical work as a function of at least one of: (i) measured resistance transmitted to the hydraulic drive unit from machinery that is coupled to and driven by the hydraulic drive unit; and (ii) hydraulic pump speed.

A preferred method of correcting the expected amount of mechanical work comprises inputting into a predetermined formula: (i) measured hydraulic fluid pressure; (ii) measured resistance transmitted from the machinery to the hydraulic drive unit; and (iii) hydraulic pump speed or measured hydraulic fluid flow rate, and using the predetermined formula to calculate a corrected expected amount of mechanical work. The predetermined formula is one that has been verified by comparing calculations of the corrected expected amount of mechanical work with empirically determined values representing actual mechanical work performed with the same values for resistance transmitted from the machinery to the hydraulic drive unit and hydraulic pump speed or hydraulic fluid flow rate. Empirical data can be used to calibrate the formula for the particular hydraulic drive system that the formula is being applied to. The predetermined formula can be empirically-based, by formulating the predetermined formula to match empirically collected data, or it can be model-based, and later calibrated and verified by comparing calculations of the corrected expected amount of mechanical work with empirically determined values for the corrected expected amount of mechanical work.

In other embodiments, the method of correcting the expected amount of mechanical work comprises adjusting the expected amount of mechanical work by referencing a look-up table. The look-up table can be a three-dimensional look-up table that determines a correction factor of a corrected value from three variables. For example, in a preferred embodiment by referencing a look-up table the corrected expected amount of mechanical work is determined from: (i) measured hydraulic fluid pressure; (ii) measured resistance transmitted from the machinery to the hydraulic drive unit; and (iii) hydraulic pump speed or measured hydraulic fluid flow rate. The look-up table can be built from empirically derived corrected expected amounts of mechanical work or empirically derived correction factors that can be applied to the expected amounts of mechanical work to determine the corrected expected amount of mechanical work.

In yet another embodiment, the method of correcting the expected amount of mechanical work comprises using both correction factors and predetermined formulas. Like in the other embodiments, measured parameters such as: (i) measured hydraulic fluid pressure; (ii) measured resistance transmitted from the machinery to the hydraulic drive unit; and (iii) hydraulic pump speed or measured hydraulic fluid flow rate, can be used to determine the correction factors or corrected values. For example, with these measured parameters a look-up table can be used to correct for changes in hydraulic system pressure and a predetermined formula can be used to correct for the measured resistance, for example, from changes in process fluid pressure downstream from the process fluid pump that is driven by the hydraulic drive unit, so that values corrected using correction factors and predetermined formulas are used to determine the corrected expected amount of mechanical work.

In preferred embodiments the adjustments made to measured hydraulic fluid pressure can also correct for differences between a location where a sensor measures hydraulic fluid pressure and the hydraulic fluid pressure in the hydraulic drive unit. This is particularly important for hydraulic drive systems that are used to drive a plurality of hydraulic drive units, and there can be differences between the correction factors depending upon which hydraulic drive unit is being driven, arising for example, from differences between the hydraulic drive units and in the hydraulic piping to the different hydraulic drive units.

An application known to be particularly suited to the disclosed method, the machinery coupled to and driven by the hydraulic drive unit is a positive displacement pump with a reciprocating piston for pumping a process fluid from a process fluid storage vessel to a delivery conduit or accumulator vessel. In this application, the resistance transmitted to the hydraulic drive unit from the positive displacement pump is a function of process fluid pressure measured in the delivery conduit or the accumulator vessel. The method further comprises measuring the process fluid pressure downstream from a discharge outlet of the positive displacement pump and adjusting the corrected expected amount of mechanical work in direct proportion to changes in the measured process fluid pressure. The preferred method further comprises adjusting the corrected expected amount of mechanical work as a function of hydraulic pump speed or hydraulic fluid flow rate.

The method can further comprise stopping hydraulic fluid flow to the hydraulic drive unit when the calculated amount of mechanical work is less than the expected amount of mechanical work for a predetermined number of the drive cycles or if the calculated amount of mechanical work is less than the expected amount of mechanical work by a predetermined amount more than the predetermined margin. A small calculated amount of mechanical work can indicate that the storage vessel from which the process fluid is being pumped is empty or close to being empty, or that there is an equipment failure such as a broken drive shaft. The electronic controller can use the calculated amount of mechanical work in combination with other measured parameters to determine the cause of abnormal operating condition. For example, if the calculated amount of mechanical work is smaller than expected, and the process fluid pressure measured downstream from the pump discharge outlet is also below a low pressure threshold, and the end user of the process fluid is not consuming all of the process fluid that is being pumped to it, the electronic controller can determine that there is a leak in the process fluid system. Accordingly, this example shows that the control parameters corrected by the disclosed method can be used in combination with other control parameters to further refine the diagnostic capabilities and further improve operation of the hydraulic drive system and the machinery that it drives.

The method can be applied to a hydraulic drive system having a hydraulic drive unit that comprises a reciprocating hydraulic piston with a mechanically operable shuttle valve that automatically opens at the end of a hydraulic piston stroke to allow hydraulic fluid to flow from one side to the other side of the hydraulic piston. The method further comprises accurately determining the timing for the hydraulic piston completing its stroke, ending the drive cycle, and switching hydraulic fluid flow direction to begin a stroke of the hydraulic piston in an opposite direction, but determining when measured hydraulic fluid pressure decreases after the shuttle valve opens, and the measured hydraulic fluid pressure crosses the corrected pressure threshold value. That is, the method can comprise detecting the change in the hydraulic fluid pressure when the shuttle valve opens by detecting when the measured hydraulic fluid pressure crosses a predetermined pressure threshold value. The method teaches adjusting the predetermined pressure threshold value to the corrected pressure threshold value proportionally with changes in process fluid pressure and/or other changes in resistance transmitted to the hydraulic drive unit from the machinery that it drives. Correcting the pressure threshold value improves the method of detecting abnormal operating conditions because more accurately determining the timing of the end of the drive cycle enables more accurate calculation of the amount of mechanical work performed by the hydraulic drive unit. If hydraulic fluid pressure is measured between the hydraulic pump and the hydraulic drive unit and the corrected pressure threshold value is preferably also adjusted proportionally with changes in hydraulic pump speed or changes in hydraulic fluid flow rate.

If the disclosed method fails to detect the end of a piston stroke, for example, if there is a problem with the pressure sensor for measuring hydraulic fluid pressure, the method can further comprise a back-up feature for switching hydraulic fluid flow to reverse the hydraulic piston at the end of a piston stroke. The back-up feature can comprise estimating volume displaced by a hydraulic piston in the hydraulic drive unit from measured hydraulic pump speed or measured hydraulic fluid flow rate, and switching hydraulic fluid flow direction to begin a stroke of the hydraulic piston in an opposite direction when estimated displaced volume is greater than a predetermined volume. This back-up method can result in more idle time between piston strokes compared to the preferred control method disclosed herein which detects the change in hydraulic system pressure, and in preferred embodiments the back-up feature is only engaged if the preferred control method fails to switch hydraulic fluid flow at the end of a hydraulic piston stroke.

A hydraulic system for practicing the disclosed method comprises a hydraulic fluid reservoir in which hydraulic fluid can be stored; a hydraulic pump for pumping hydraulic fluid from the reservoir; a hydraulic drive unit operable to: (i) receive hydraulic fluid from the hydraulic pump; (ii) convert hydraulic fluid pressure to mechanical movements in machinery that is coupled to and driven by the hydraulic drive unit; and (iii) return the hydraulic fluid to the reservoir; a plurality of conduits for conveying hydraulic fluid and connecting the hydraulic fluid reservoir, the hydraulic pump, and the hydraulic drive unit; a pressure sensor associated with a hydraulic fluid supply conduit between a discharge from the hydraulic pump and an inlet to the hydraulic drive unit for measuring hydraulic fluid pressure; and an electronic controller. The electronic controller is programmed to: monitor a signal representative of hydraulic fluid pressure that is measured by the pressure sensor and switch the direction of hydraulic fluid flow to and from the hydraulic drive unit or stop the flow of hydraulic fluid flow to the hydraulic drive unit to end a drive cycle as a function of measured hydraulic fluid pressure relative to a predetermined pressure threshold value; and adjust the predetermined pressure threshold value as a function of at least one of: (i) measured mechanical or fluid resistance transmitted to the hydraulic drive unit from the machinery that is coupled to and driven by the hydraulic drive unit; and (ii) hydraulic pump speed; and calculate an amount of mechanical work done by the hydraulic drive unit in the drive cycle as a function of the measured hydraulic fluid pressure and at least one of hydraulic pump speed during the drive cycle, time to complete the drive cycle, and the volume displaced by a hydraulic piston in the hydraulic drive unit during the drive cycle; and, warn an operator or stop hydraulic fluid flow to the hydraulic drive unit when the calculated mechanical work for the drive cycle is less than an expected amount of mechanical work by a predetermined margin, the expected amount of mechanical work being calculated as function of an expected peak hydraulic system pressure. Requiring the calculated amount of mechanical work to be less than the first predetermined amount for a predetermined number of cycles helps to filter out false indicators, which can occur, for example if the hydraulic system is employed to drive a pump in a mobile application where there is some variability in the level of the process fluid near the pump intake caused by the effects of vehicle motion on the stored fluid. That is, the vehicle motion can be the cause of the reduced calculated amount of mechanical work and not abnormal operating conditions. However, if the calculated amount of mechanical work is less than a second predetermined amount, this reduced area can be so small that it is more definitive of an abnormal operating condition, and in this way different predetermined threshold values can be employed by the disclosed method to better determine whether there are in fact abnormal operating conditions, and if so, what action to take.

In a preferred embodiment the electronic controller is programmed to calculate the amount of mechanical work done by the hydraulic drive unit by determining an area under a plot of measured hydraulic fluid pressure against volume displaced by a hydraulic piston in the hydraulic drive unit. For more robust diagnosis of the mechanical work performed by the hydraulic drive system, the electronic controller can be programmed to correct the expected amount of mechanical work as a function of at least one of: (i) measured resistance transmitted to the hydraulic drive unit from machinery that is coupled to and, driven by the hydraulic drive unit; and (ii) hydraulic pump speed.

The hydraulic drive unit can comprise a reciprocating piston actuated by delivering the hydraulic fluid to a hydraulic cylinder on one side of the piston and draining the hydraulic fluid to the hydraulic fluid reservoir from the hydraulic cylinder on an opposite side of the piston. The reciprocating piston comprises a shuttle valve with a valve member that is mechanically actuated to automatically move to an open position at the end of each piston stroke. When the shuttle valve is open, the hydraulic fluid can flow from one side of the reciprocating piston to the opposite side thereof, so that the hydraulic piston stops at the end of each piston stroke without sustaining excessive impacts against the end plate at the end of each stroke, and so that the hydraulic drive unit is idle until the hydraulic fluid flow is reversed. The valve member is movable to a closed position when hydraulic fluid flow reverses direction.

If the machinery that is coupled to and driven by the hydraulic drive unit is a double-acting positive displacement pump, the electronic controller can be programmed to recognize two distinct predetermined pressure threshold values to determine when the reciprocating piston has reached the end of a piston stroke. Commonly hydraulic drive units employ a drive piston attached to a drive shaft so that the chamber with the shaft has a smaller piston area, and when this chamber is the working chamber being filled with high pressure hydraulic fluid, because of the smaller area, compared to when the opposite chamber is doing the work, higher hydraulic fluid pressure is needed to pump the process fluid to the same pressure, and the disclosed method and apparatus accounts for this with different predetermined pressure threshold values associated with the different chambers of the hydraulic drive unit. If the machinery that is coupled to the hydraulic drive unit is a single acting positive displacement pump, the electronic controller is programmed to recognize a first predetermined pressure threshold associated with a decrease in hydraulic fluid pressure at the end of a working piston stroke, and a second predetermined pressure threshold associated with an increase in hydraulic fluid pressure at the end of a non-working piston stroke. FIGS. 7 and 8 are plots of the hydraulic fluid pressure for a single-acting positive displacement pump driven by a hydraulic drive system as disclosed herein.

In a preferred embodiment, the electronic controller is programmed with a predetermined formula that calculates a corrected predetermined pressure threshold value or a correction factor that is applied to the predetermined pressure threshold value to determine the corrected predetermined pressure threshold value, from data inputs of: (i) measured hydraulic fluid pressure; (ii) measured resistance transmitted from the machinery to the hydraulic drive unit; and (iii) hydraulic pump speed or measured hydraulic fluid flow rate.

In other embodiments, the apparatus can further comprise a look-up table that the electronic controller is programmed to reference to retrieve therefrom a corrected predetermined pressure threshold value or a correction factor that is applied to the predetermined pressure threshold value to determine the corrected predetermined pressure threshold value. In one embodiment, the look-up table is a three-dimensional look-up table with the inputs being measured hydraulic fluid pressure, measured resistance transmitted from the machinery to the hydraulic drive unit, and hydraulic pump speed. The look-up table can be empirically derived.

If the machinery coupled to the hydraulic drive unit comprises a positive displacement pump, like in the illustrated embodiments, the apparatus can further comprises a plurality of storage vessels for holding a process fluid and conduits and valves for selectively delivering process fluid from one of the storage vessels.

The hydraulic drive unit can be one of a plurality of hydraulic drive units, each coupled to a positive displacement pump associated with a respective process fluid storage vessel, and conduits and valves fluidly connect the hydraulic pump to each one of the hydraulic drive units and the electronic controller is programmed to operate the valves to control the direction of hydraulic fluid flow and which hydraulic drive units are operated and which hydraulic drive units are idle.

DETAILED DESCRIPTION OF PREFERRED EMBODIMENT(S)

With reference to the figures, like-named components with like reference numbers separated by multiples of one hundred refer to like components and data in different embodiments and examples. Because a particularly useful application for the disclosed apparatus and method is pumping a liquefied gas stored at a cryogenic temperature from a cryogenic storage vessel, this example is used to describe the preferred embodiments illustrated by the figures. However, persons skilled in the technology will understand that the disclosed apparatus and method can be applied to pumping other process fluids that need not be stored at cryogenic temperatures, such as, for example, propane, and that it can also be applied to other applications that use a hydraulic drive system. The method and apparatus is particularly useful if there is variable resistance from the driven machinery, and/or, if the hydraulic pump is driven at a variable speed.

Figure 2:
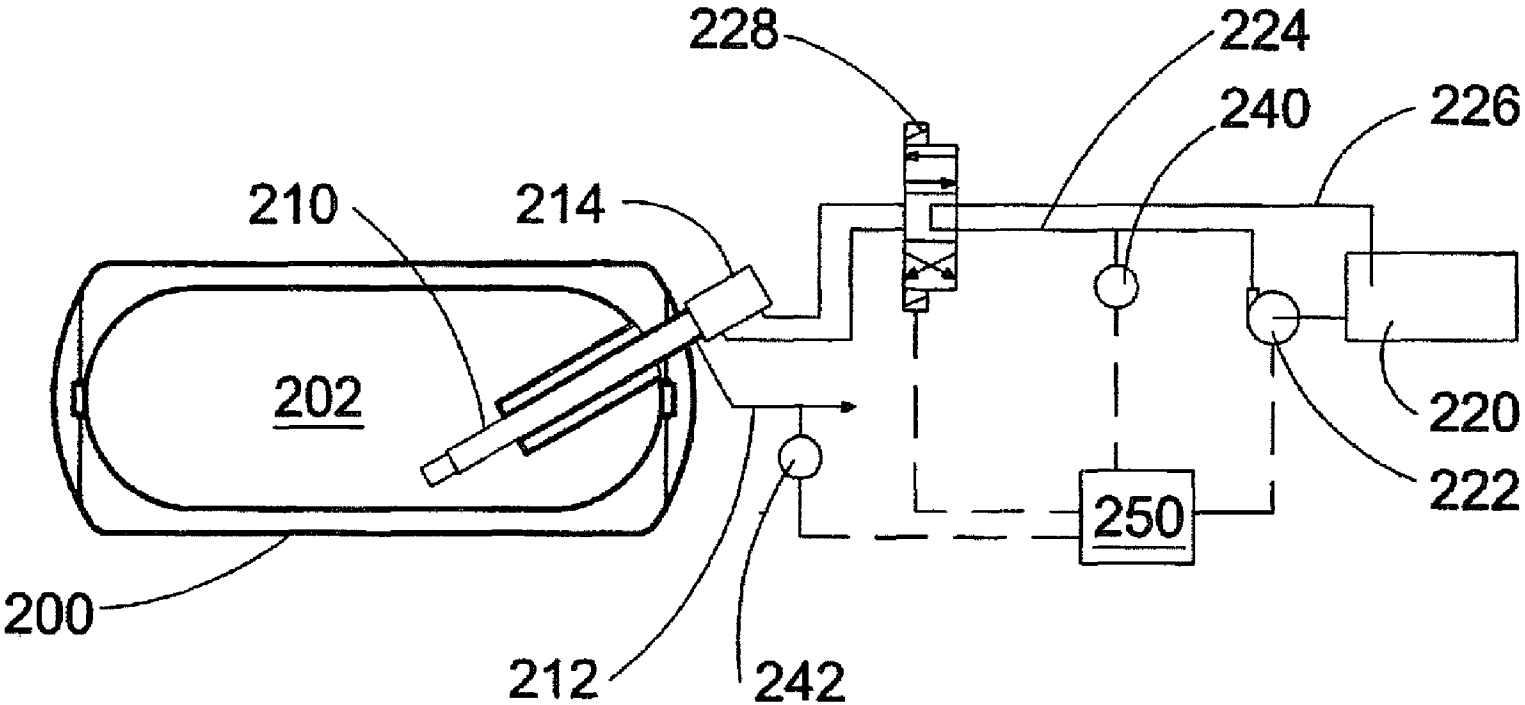
FIG. 2 is a schematic diagram of a storage vessel with an internal pump, a hydraulic drive, a hydraulic fluid pressure sensor, and an electronic controller.
Figure 3:
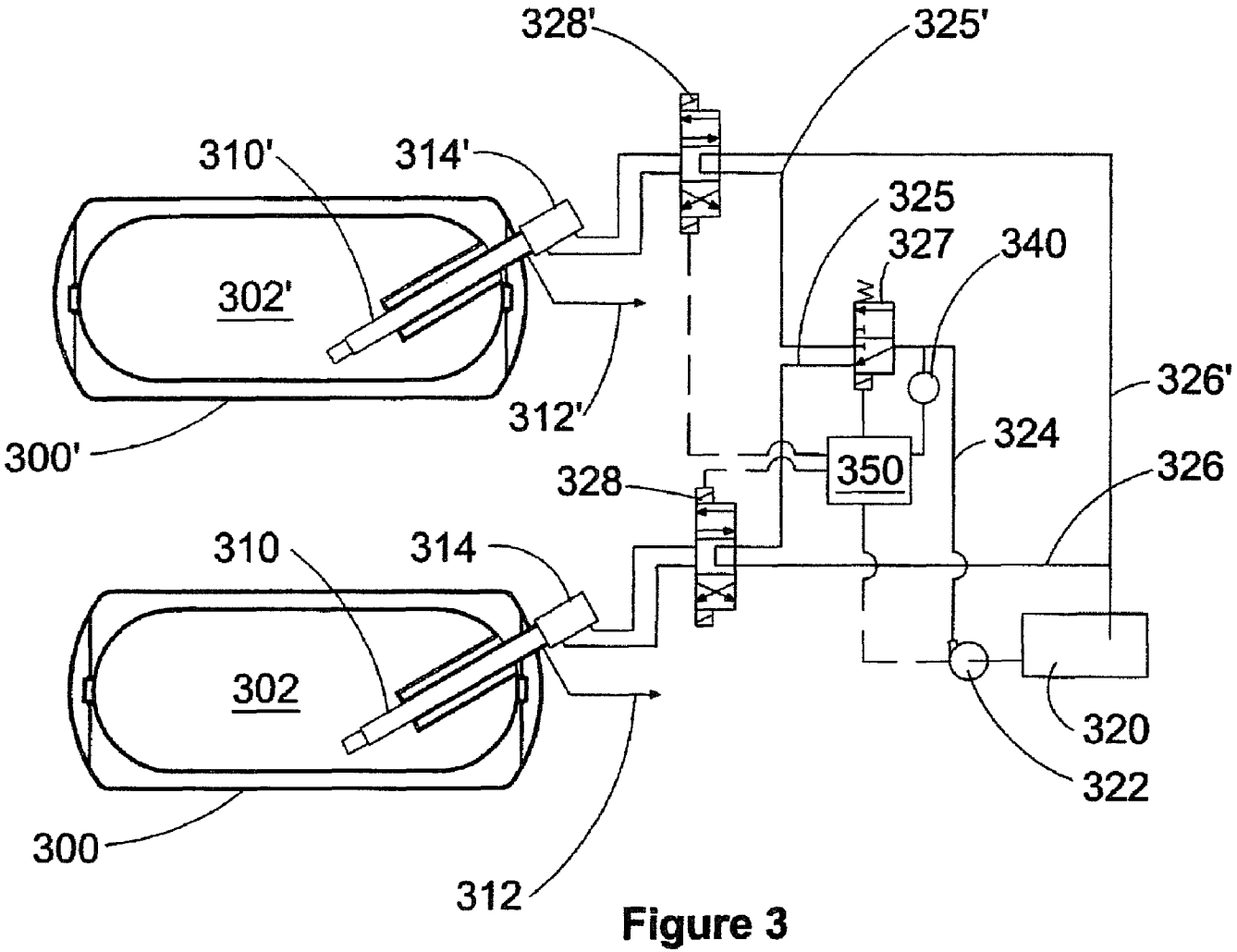
FIG. 3 is a schematic diagram of a system with two storage vessels, each with an internal pump and a hydraulic drive, and hydraulic fluid pressure sensor and an electronic controller.
Figure 4:
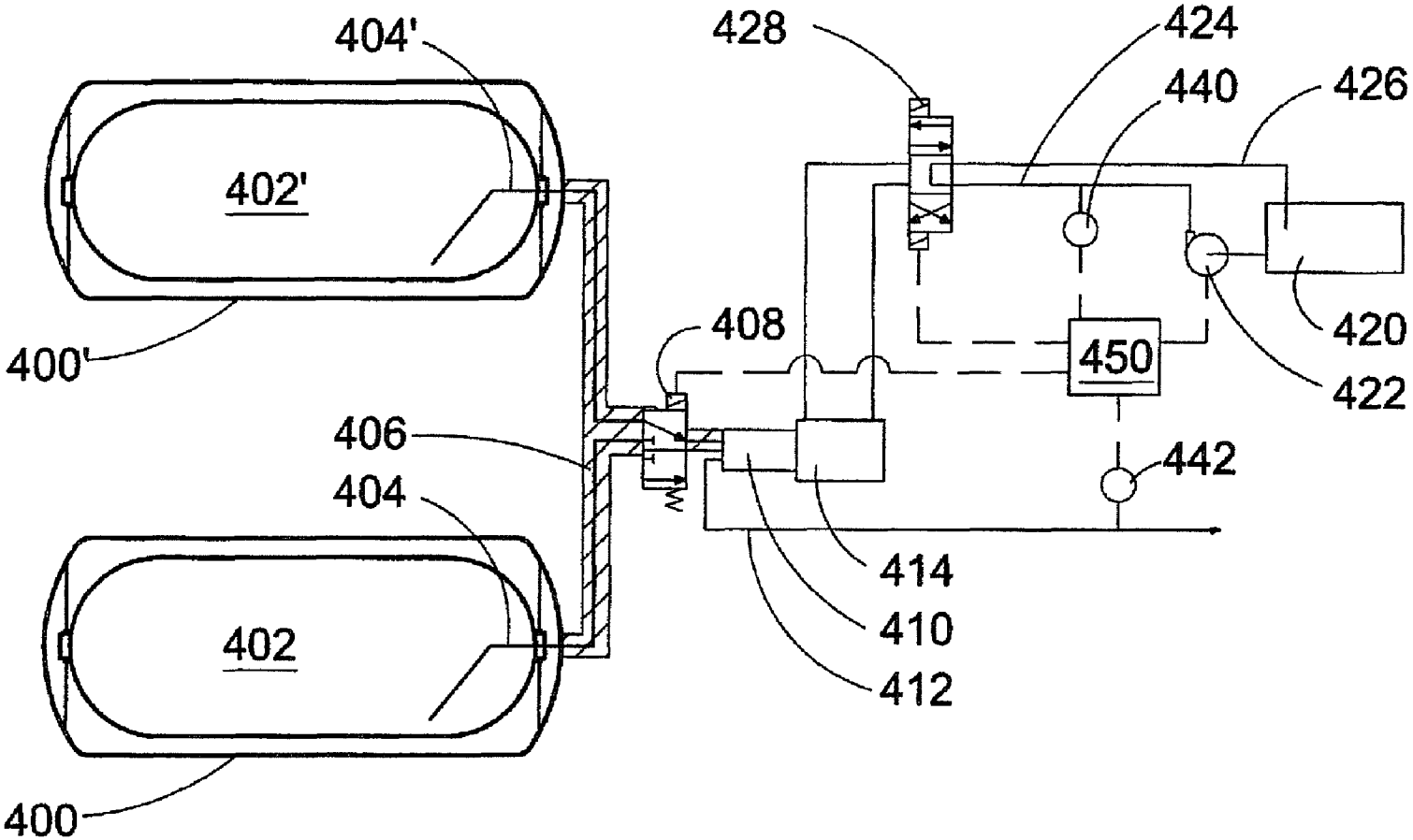
FIG. 4 is a schematic diagram of a system with two storage vessels and an external pump in communication with the respective storage spaces of the two storage vessels, a hydraulic drive, a hydraulic fluid pressure sensor, and an electronic controller.

FIGS. 2-4 illustrate schematic views of different embodiments for using a hydraulic drive system to drive one or more positive displacement reciprocating piston pumps for delivering a cryogenic fluid, from one or more storage vessels. With reference first to the embodiment of FIG. 2, an apparatus is illustrated for pumping a cryogenic fluid from storage vessel 200 that defines thermally insulated cryogen space 202. In this illustrated embodiment cryogenic pump 210 is disposed within cryogen space 202 and is suitable for pumping a cryogenic fluid from cryogen space 202 to conduit 212. Cryogenic pumps are well known and cryogenic pump 210 can employ a single-acting piston or a double acting piston, and can be a single stage pump or a multi-stage pump.

A drive shaft operatively connects cryogenic pump 210 to hydraulic drive unit 214, which in the illustrated embodiment is located outside of the cryogen space, in the preferred embodiment, hydraulic drive unit 214 comprises a hydraulically driven piston that reciprocates by directing pressurized hydraulic fluid to opposite sides of the piston in alternating fashion. Such hydraulic drive units for producing linear reciprocating motion are well known. That is, a hydraulic fluid chamber associated with one side of the hydraulically driven piston is filled with pressurized hydraulic fluid from high-pressure conduit 224, while a hydraulic fluid chamber associated with the opposite side of the hydraulic piston communicates with drain line 226 that returns hydraulic fluid to hydraulic pump 222 or hydraulic fluid reservoir 220. The hydraulically driven piston can have a larger diameter than that of the pump piston so that the cryogenic fluid can be pumped to a higher pressure than the peak hydraulic system pressure. The hydraulic drive system comprises one or more valves that are operable when the hydraulically driven piston completes its stroke, so that by operation of the valve(s) the hydraulic fluid chamber previously in communication with drain line 226 is in communication with high-pressure conduit 224 that supplies the pressurized hydraulic fluid and the other hydraulic fluid chamber is in communication with drain line 226. Upon actuating the valves at the end of a piston stroke, and switching the hydraulic fluid connections to the hydraulic fluid chambers, the pressurized hydraulic fluid acts on the hydraulic piston to reverse the direction of linear movement. In a preferred embodiment the hydraulic fluid valve can be schematically illustrated valve 228, which comprises an electronically actuated block with ports for switching the flow from high-pressure conduit 224 from one hydraulic fluid chamber to the other at the same time that the opposite hydraulic fluid chamber is connected to drain line 226. The valve block can also include ports (shown schematically in the middle of the valve block in FIG. 2) for re-circulating the hydraulic fluid without driving hydraulic drive unit 214. This feature can be employed, for example if hydraulic pump 222 is mechanically driven by an engine and hydraulic pump 222 is continuously operated when the engine is running, and when not needed, cryogenic pump 210 can be kept idle by using valve 228 to recirculate the hydraulic fluid.

Pressure sensor 240 preferably has its sensor disposed in high-pressure conduit 224 between the hydraulic fluid discharge outlet of hydraulic pump 222 and hydraulic drive unit 214. More preferably, pressure sensor 240 is located downstream from hydraulic pump 222 and upstream from valve 228 because downstream from valve 228, during operation of hydraulic drive unit 214, the conduits alternate between pressure and drain functions. Pressure sensor 240 is intended to measure hydraulic fluid pressure that correlates to the hydraulic fluid pressure in the drive chamber of hydraulic drive unit 214 that is connected to high pressure conduit 224. If hydraulic fluid pressure is measured at hydraulic drive unit 214 or in a conduit between hydraulic drive unit 214 and valve 228, in preferred embodiments at least two pressure sensors are employed, one associated with measuring hydraulic fluid pressure on each side of the hydraulic piston in hydraulic drive unit 214.

Pressure sensor 240 communicates with electronic controller 250 to communicate the measured hydraulic fluid pressure. Responsive to the measured hydraulic fluid pressure, electronic controller 250 can be programmed to stop cryogenic pump 210 by communicating with at least one of hydraulic pump 222 and valve 228, which controls the bypass feature. Electronic controller 250 can also be programmed to use the measured hydraulic system pressure to control switching hydraulic fluid flow direction to and from hydraulic drive unit 214.

Figure 1:
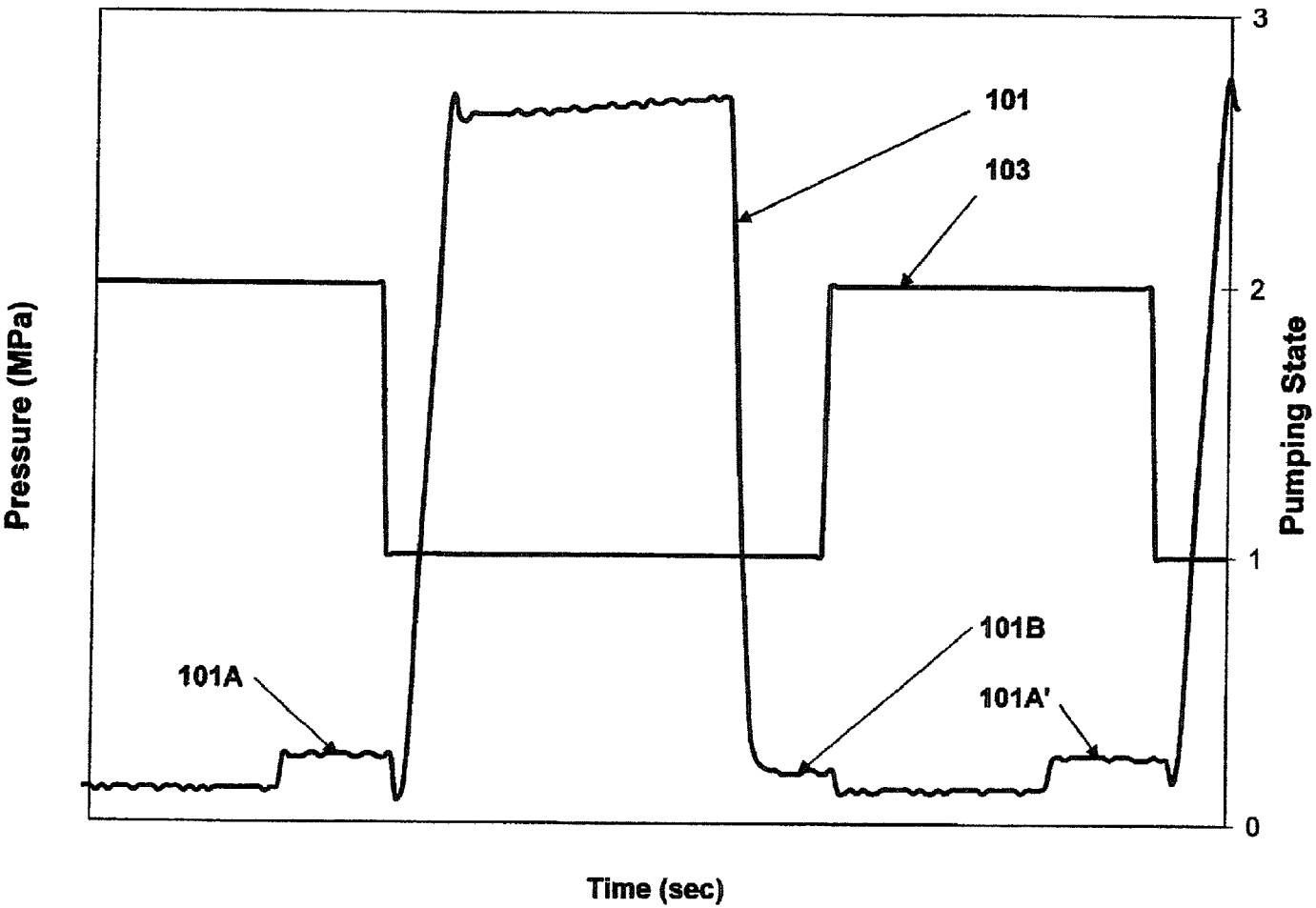
Figure 1 (Prior Art)
FIG. 1 is a graph that plots hydraulic system pressure and pumping state against time for a prior art hydraulic drive system, such as the one disclosed by the '032 application.

As will be described in more detail in the description of the method, in preferred embodiments of the disclosed apparatus, the electronic controller is programmed to adjust the hydraulic fluid pressure threshold limits used to control the hydraulic drive system to account for the effects of changing hydraulic pump speed and/or resistance from the machinery driven by the hydraulic drive system. Generally, higher hydraulic pump speeds are associated with higher measured hydraulic system pressure. Reasons for this include higher pressure drops associated with higher flow rates through the hydraulic fluid conduits and flow diverting valves, as well as higher friction resistance associated with the hydraulic piston and the driven machinery. The dashed line between hydraulic fluid pump 222 and electronic controller 250 shows that in preferred embodiments, data indicating hydraulic pump speed can be transmitted to electronic controller 250. If hydraulic pump 222 is mechanically driven by an engine (not shown), in other embodiments electronic controller 250 can determine hydraulic pump speed from engine speed, because in such embodiments hydraulic pump speed is proportional to engine speed. In the illustrative example of a hydraulically driven pump, changes in the downstream process fluid pressure have the effect of changing resistance to the hydraulic drive unit. Accordingly, electronic controller 250 can further receive signals from pressure sensor 242 indicating fluid pressure downstream from cryogenic pump 210. Pressure sensor 242 can measure process fluid pressure in conduit 212 as shown in FIG. 1, or in a downstream accumulator vessel (not shown). As will be elaborated upon further in the description of the method, by adjusting predetermined hydraulic fluid pressure threshold values to correct for changes in hydraulic pump speed and changes in the resistance from the driven machinery, the disclosed apparatus can use the measured hydraulic system pressure to operate the hydraulic drive system more efficiently, with less idle time between hydraulic piston strokes and more precise indications of when to reverse hydraulic fluid flow through a hydraulic drive unit, and when to shut down the hydraulic drive unit.

FIG. 3 is a schematic view of a multi-storage vessel embodiment of the apparatus that is a particularly suited application for the disclosed hydraulic drive system. This embodiment is much like the embodiment of FIG. 2, except that there are two storage vessels 300 and 300', with each one defining its own cryogen space 302 and 302' respectively. Each storage vessel has a respective cryogenic pump 310 and 310', which delivers cryogenic fluid to respective conduits 312 and 312'. The hydraulic drive system comprises hydraulic pump 322 which delivers pressurized hydraulic fluid from reservoir 320 through high pressure conduits 324, 325, and 325', and valves 327, 328 and 328' to one of separate hydraulic drive units 314 and 314' for driving respective cryogenic pumps 310 and 310'. Hydraulic fluid is drained from hydraulic drive units 314 and 314' back to reservoir 320 through drain lines 326 and 326'. Pressure sensor 340 is positioned on high-pressure conduit 324 to measure hydraulic fluid pressure. Only one pressure sensor is needed if positioned between hydraulic pump 322 and valve 327 since high-pressure conduit 324 supplies pressurized hydraulic fluid to the selected one of hydraulic drive units 314 and 314'. However, because hydraulic fluid flows through valve 327 and one of conduits 325 and 325' and one of valves 328 and 328' en route to hydraulic drive unit 314 or 314' there can be significant pressure losses which can result in the hydraulic fluid pressure measured by pressure sensor 340 being higher than the actual hydraulic fluid pressure in the hydraulic drive unit. Accordingly, in preferred embodiments to correct for this difference, hydraulic fluid pressure measurements taken by pressure sensor 340 are adjusted or the predetermined pressure threshold values are adjusted.

In preferred embodiments, electronic controller 350 receives inputs from pressure sensor 340 and processes the measured hydraulic system pressure to control the hydraulic drive system according to the disclosed method, using predetermined pressure threshold values that are adjusted to be corrected as a function of at least one of: (i) measured resistance transmitted to the hydraulic drive unit from the machinery coupled to it; and (ii) hydraulic pump speed. In preferred embodiments, when the hydraulic drive system has a variable speed hydraulic pump, the corrected pressure threshold is corrected for both the measured resistance to the hydraulic drive unit from the driven machinery and the hydraulic pump speed. Electronic controller 350 knows from the commanded position of selector valve 325 which one of cryogenic pumps 310 and 310' is being operated to pump cryogenic fluid, and associates the measured hydraulic system pressure with that cryogenic pump.

Electronic controller 350 is programmable to command operation of valves 325, 328 and 328', and in some embodiments, the speed of hydraulic pump 322. For example, hydraulic pump can be driven by an electric motor with a variable speed controller. In other embodiments, there is no need to control the operation of hydraulic pump 322 if it is allowed to operate continuously, for example, if hydraulic pump 322 is mechanically driven and directly coupled to an engine. If hydraulic pump 322 operates continuously, cryogenic pumps 310 and 310' can be stopped by selecting the shown middle positions for valves 328 and 328', in which the pressurized hydraulic fluid is re-circulated and by-passes hydraulic drive units 314 and 314'.

Apart from there being two storage vessels and two cryogenic pumps arranged in parallel, the method of operating the apparatus of FIG. 3 is much the same as the method of operating the apparatus of FIG. 2, with the additional feature of being able to operate valve 327 to switch between hydraulic drive units 314 and 314' to selectively deliver process fluid from storage vessel 302 or 302', respectively.

To demonstrate the broad applicability of the disclosed hydraulic drive system and method, FIG. 4 is a schematic view of another embodiment of a multi-storage vessel arrangement for delivering a process fluid from storage vessels 400 and 400', to which the disclosed hydraulic drive system can be advantageously applied. Similar to the other embodiments, pressure sensor 440 measures the pressure of the hydraulic fluid in high-pressure conduit 424 so that the disclosed method can be employed to determine when to switch hydraulic fluid flow to hydraulic drive unit 414, when to operate valve 408 to switch from one storage vessel to the other, and when to shut down hydraulic drive unit 414. While FIG. 4 only shows two storage vessels to illustrate this embodiment, it will be understood by persons skilled in this technology that the apparatus can comprise a greater number of storage vessels and function in substantially the same manner. The apparatus of FIG. 4 is different from the apparatus of FIG. 3 in that cryogenic pump 410 is disposed outside of cryogen spaces 402 and 402', and conduits 404 and 404' which supply cryogenic fluid to the inlet of cryogenic pump 410, are surrounded by thermal insulation 406 to reduce heat leak and keep the cryogenic fluid at cryogenic temperatures until it is delivered to cryogenic pump 410. Valve 408 selects the storage vessel that is in fluid communication with cryogenic pump 410, and valve 408, is also preferably thermally insulated (in the simplified illustration of this embodiment, thermal insulation is not shown around valve 408 in FIG. 4). Cryogenic fluid is discharged from cryogenic pump 410 into conduit 412.

Because the multi-storage vessel arrangement of FIG. 4 employs only one cryogenic pump, the arrangement for the hydraulic drive system, comprising reservoir 420, hydraulic pump 422, high pressure conduit 424, drain line 426, and the manner in which these conduits are connected to hydraulic drive unit 414 through valve 428 is substantially the same as the arrangement of like-numbered elements of FIG. 2. Electronic control unit 450 receives measurements of hydraulic fluid pressure from pressure sensor 440 and sends command signals to valves 408 and 428, and in some embodiments, also to hydraulic pump 422. Electronic controller 450 also receives signals indicating directly or indirectly at least one of hydraulic pump speed and measured resistance transmitted to hydraulic drive unit 414 from cryogenic pump 410, which in this example can be a signal from pressure sensor 442 indicating process fluid pressure in conduit 412. In other embodiments (not shown) sensor 442 can be located further downstream from cryogenic pump 410 to measure process fluid pressure, for example, in an accumulator vessel.

Although FIG. 4 shows an arrangement with two storage vessels and one cryogenic pump, it is understood that in other embodiments, more than one cryogenic pump can be employed, with a plurality of cryogenic pumps disposed outside of the cryogen space like the one shown in FIG. 4 with each pump being able to deliver cryogenic fluid from any one of a plurality of storage vessels. While there are a number of advantages associated with locating the pump inside the storage vessel, such an arrangement adds to the manufacturing cost of such storage vessels, compared to storage vessels that are not required to accommodate an internal cryogenic pump. With an internal cryogenic pump disposed within the cryogen space of a storage vessel, a cryogenic pump is needed for each storage vessel in a multi-storage vessel system. An internal cryogenic pump can also be more difficult to service. On the other hand, a challenge for external pumps is providing sufficient thermal insulation for the conduit between the storage vessel(s) and the cryogenic pump, and for the cryogenic pump itself. External pumps typically require a cool-down procedure upon start up, before the pump can perform normally. Accordingly, there are advantages and disadvantages associated with both arrangements, for cryogenic pumps disposed within the cryogen space of the storage vessels and for cryogenic pumps located outside the cryogen spaces. The choice of one arrangement over the other can be a matter of user preference and/or cost considerations. As shown by the illustrated embodiments, irrespective of whether the cryogenic pump(s) are located inside or outside the cryogen space defined by the storage vessel(s), the disclosed apparatus and method can be applied with substantially the same results.

Arrangements with more than one cryogenic pump, whether located internally or externally from the storage vessels, can provide some redundancy to yield a more robust system. Pump performance can degrade over time, for example because of worn seals and other normal wear to pump components. A multi-pump arrangement can also provide extra pumping capacity that can allow the pumps to be sized smaller, if the hydraulic drive system and the piping to the pumps allow selective operation either individually or at the same time. In embodiments with external cryogenic pumps, it can also allow a modular system that can be expanded to adapt to the requirements of a particular application, without requiring the number of cryogenic pumps to match the number of storage vessels. That is, rather than requiring the design of different sized cryogenic pumps, adding to development, manufacturing, and inventory costs, a cryogenic pump of one standardized size can be developed, with only the number of pumps changing depending upon the needed flow capacity.

Now that illustrative examples of the hydraulic drive system have been described, the method of operating the system will be described in more detail. Each of the described embodiments can benefit from the disclosed method of diagnosing and controlling a hydraulic drive system. The method comprises measuring hydraulic fluid pressure in hydraulic fluid supply conduit 224, 324, 424 between hydraulic fluid pump 222, 322, 422 and hydraulic drive unit 214, 314, 314', 414, 414'. In the illustrated embodiments, pressure sensors 240, 340 and 440 can be used to take this pressure measurement and deliver this data to respective electronic controllers 250, 350 and 450. To practice the method, the pressure sensor need not be associated with respective conduits 224, 324 and 424 as long as the electronic controller receives hydraulic fluid pressure data representative of the pressure in the working chamber of the hydraulic drive unit. For example, if the hydraulic drive unit has a reciprocating hydraulically driven piston it does not matter where the pressure sensor is positioned as long as the hydraulic fluid pressure measurements correlate to the pressure in the hydraulic cylinder that is in fluid communication with respective high pressure hydraulic fluid conduit 224, 324 or 424. This means that if the pressure sensor is located downstream from valve 228, 327 or 428, more than one pressure sensor is needed. However, depending on the location of the sensor, the measured hydraulic fluid pressure can be adjusted to correct for differences between where the pressure is measured and the hydraulic fluid pressure in the hydraulic drive unit, or, to achieve the same result, instead of adjusting the measured hydraulic fluid pressure, the predetermined pressure threshold values can be adjusted to correct for the differences associated with the location of the pressure sensor. For example, with reference to FIG. 2, the hydraulic fluid pressure measured by pressure sensor 240 will be higher than the hydraulic fluid pressure in the hydraulic drive unit because of pressure losses associated with the hydraulic fluid flowing through the conduits and through valve 228, the inlet and outlet of hydraulic drive unit 214, and the pass through valve and fluid passages through the hydraulically driven piston within hydraulic drive unit 214. In addition, the adjustment to correct for the pressure losses is not fixed, because pressure losses increase if hydraulic pump speed and hydraulic fluid flow rate increases. That is, while an increase in hydraulic fluid pressure measured by sensor 240 will correlate to an increase in hydraulic fluid pressure in the hydraulic drive unit, because of factors such as pressure losses in the hydraulic drive system, the pressure increase at the hydraulic drive unit will not be as large as the pressure increase in high pressure conduit 224.

Figure 5:
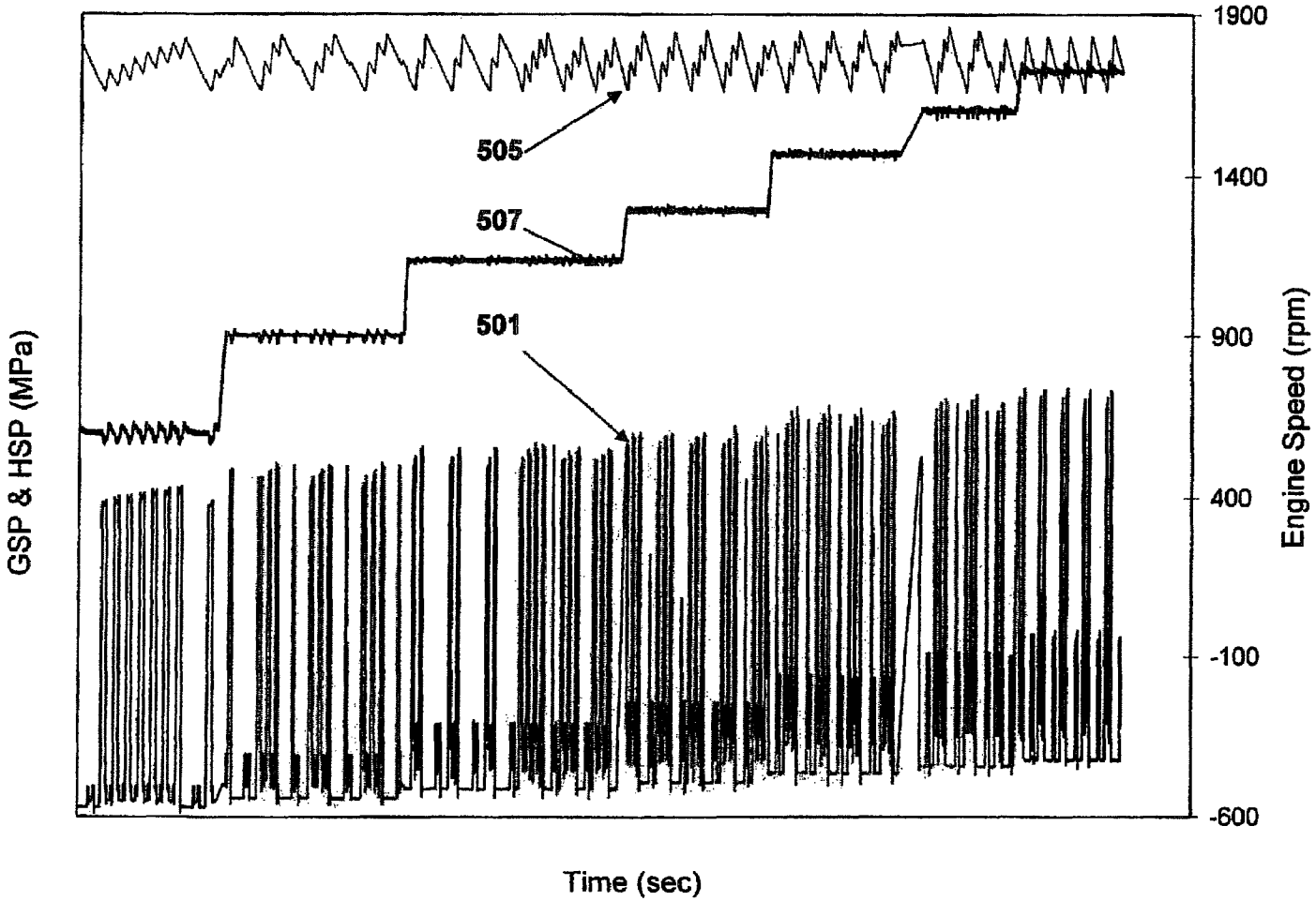
FIG. 5 is a graph of data collected from a hydraulic drive system, with the graph plotting hydraulic system pressure and hydraulic pump speed against time, showing how hydraulic pump speed affects hydraulic system pressure.

Beyond pressure losses there are other factors associated with changing hydraulic pump speed and hydraulic flow rate, which also cause differences between the measured hydraulic fluid pressure and the hydraulic fluid pressure in the hydraulic drive unit. Some of these other factors include increased friction associated with higher flow rates, and increased hydraulic fluid leakage associated with higher hydraulic fluid flow rate. FIG. 5 is a plot of data collected from a system like one of the illustrated embodiments, with the graph plotting hydraulic system pressure (HSP), process fluid pressure and engine speed against time. In the apparatus used to collect this data, the hydraulic pump was driven by the engine so hydraulic pump speed is directly proportional to engine speed. Line 501 plots the measured hydraulic system pressure. The process fluid pumped from the storage vessel was a liquefied gas, so the process fluid pressure plotted by line 505 was a measured gas system pressure (GSP). The gas was natural gas that was being consumed as fuel by the engine, so line 505 increased with each pump cycle, and declined as the gas was consumed. Line 507 is a plot of the engine speed, which was raised in steps to show the effect of increasing hydraulic pump speed and hydraulic fluid flow rate on hydraulic system pressure (HSP). FIG. 5 shows that the measured peak hydraulic fluid pressure increased as hydraulic pump speed and hydraulic fluid flow rate increased. The measured peak hydraulic system pressure at around 600 rpm was only about 75% of the measured peak hydraulic system pressure at about 1700 rpm, so if no adjustments are made to the measured hydraulic fluid pressure or to the predetermined hydraulic fluid pressure threshold value, using the hydraulic system pressure as a control parameter for operating a hydraulic drive system can result in inconsistent results and inefficient operation. For example, if the hydraulic pump speed is increased, the predetermined pressure threshold value for detecting the end of a piston stroke can be increased. When the predetermined threshold value relates to the falling edge at the end of a pumping stroke, this means that the end of stroke will be detected sooner. When the predetermined threshold value relates to the rising edge at the end of an intake stroke, increasing the threshold value can prevent false indications of the end of stroke that can be caused by signal noise.

Therefore, operation of the hydraulic drive unit can be improved by adjusting the measured hydraulic system pressure or the predetermined pressure threshold values to account for at least some of the differences caused by changing hydraulic fluid flow rate, and in preferred embodiments, all of the above-cited differences are accounted for, namely the differences attributable to pressure losses, friction, and leakage rate, by adjusting the measured hydraulic fluid pressure or the predetermined pressure threshold values that are used to control the operation of the hydraulic drive system. For example, in a preferred embodiment, measured hydraulic fluid pressure is used to control the timing for reversing the hydraulically driven piston by detecting when the measured hydraulic pressure falls below a predetermined pressure threshold value. However, as shown by FIG. 5, the peak hydraulic system pressure can change from cycle to cycle as a function of hydraulic pump speed, and if the measured hydraulic fluid pressure or the predetermined hydraulic fluid pressure threshold value is not adjusted to correct for such variations the result can be inconsistent performance and inefficient operation. Accordingly, in preferred embodiments of the method and apparatus, the relationship between measured hydraulic fluid pressure and hydraulic pump speed or the hydraulic fluid flow rate to the hydraulic drive unit is accounted for by correcting the measured hydraulic fluid pressure or the predetermined pressure threshold values using a predetermined formula or a look-up table. The predetermined formula or look-up table takes the measured hydraulic fluid pressure and the hydraulic pump speed (or another indicator of hydraulic fluid flow rate such as engine speed or the hydraulic fluid flow rate measured by a flow meter), and produces a correction factor that can be applied to the measured hydraulic fluid pressure or to the predetermined pressure threshold values to correct for the influence of the hydraulic pump speed or the hydraulic fluid flow rate. In another embodiment, instead of a correction factor the predetermined formula or the look-up table can directly produce a corrected hydraulic fluid pressure value or a corrected pressure threshold value, in the illustrated examples, changes in hydraulic pump speed are directly proportional to hydraulic fluid flow rate and in this disclosure these terms are used interchangeably to mean the same thing since they have the same influence on measured hydraulic fluid pressure. However, in other embodiments (not shown), the hydraulic pump can deliver hydraulic fluid to other hydraulically driven devices, such as power steering in a vehicle, and in such cases there can be differences between the effect of changes in hydraulic pump speed and changes in the hydraulic fluid flow rate flowing to the hydraulic drive unit, and in such systems it is the changes in hydraulic fluid flow rate that is used to determine correction factors for the disclosed method and apparatus. Therefore, for systems with a plurality of devices driven by hydraulic fluid delivered from the hydraulic pump, a flow meter or other means for determining the hydraulic fluid flow rate flowing to the hydraulic drive unit is employed to determine the correction factor for adjusting the measured hydraulic fluid pressure or the predetermined pressure threshold value.

With reference to the illustrative example shown in FIG. 2, the hydraulic pump speed (or the engine speed, if the pump is driven by an engine) is reported to electronic controller 250, which uses this data to determine a correction factor using a predetermined formula to compute the correction factor or by referencing a look-up table, to account for the influence of the variable hydraulic fluid flow rate to hydraulic drive unit 214. The data stored and output from the look-up table can be in the form of correction factors that electronic controller 250 is programmed to apply to the measured pressure values or to the predetermined threshold values, or the data output from the look-up table can be corrected values that can be processed directly by electronic controller 250.

Figure 6:
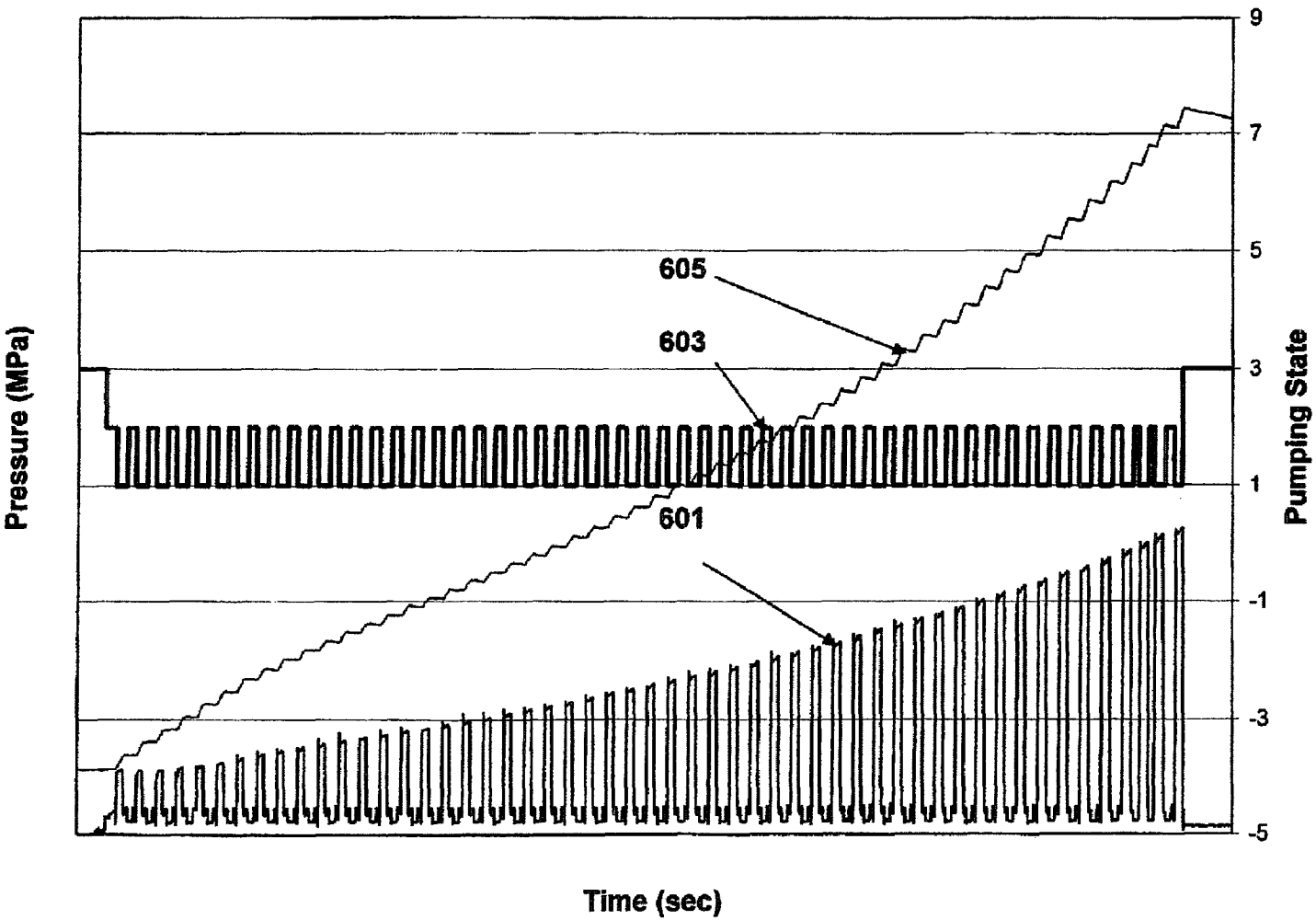
FIG. 6 is a graph of data collected from a hydraulic drive system employed to drive a reciprocating piston pump for a process fluid, with the graph plotting hydraulic system pressure, process fluid pressure, and pumping state against time, showing how process fluid pressure affects hydraulic system pressure.

In preferred embodiments of the method, the adjustments made to the measured hydraulic system pressure or the predetermined threshold values are not limited to adjustments solely for hydraulic pump speed. Another significant factor that can influence measured hydraulic system pressure is the resistance transmitted to the hydraulic drive unit from the machinery that is driven by the hydraulic drive system. Generally, higher resistance from the machinery results in higher hydraulic system pressures. With reference for example to the illustrative examples of a hydraulic drive system for driving a reciprocating piston pump shown in FIG. 2-4, the data plotted by FIG. 6 shows the significant influence that the resistance transmitted from the pump has on hydraulic system pressure. Line 605 is a plot of process fluid pressure downstream from the process pump discharge. Line 603 is a plot that shows the pumping state, with a value of 1 indicating that the pump piston is in an extending stroke, discharging process fluid from the pump cylinder, a value of 2 indicating that the pump piston is in a retracting stroke, drawings process fluid into the pump cylinder, and a value of 3 indicating that the pump is idle. Line 601 is a plot of the measured hydraulic system pressure which shows an increase in peak hydraulic system pressure of almost 500% from the left hand side of the graph to the right hand side. The plotted data shows a range of process fluid pressures to demonstrate the relationship, and such a plot could occur when the pump is initially charging the process system from a low pressure to an operating pressure, but under normal operating conditions the process fluid pressure would not typically fluctuate over such a large range. Nevertheless, FIG. 6 shows that the effect of resistance from the machinery driven by the hydraulic drive system can have a significant effect on the peak hydraulic system pressure in each pump cycle, in preferred embodiments of the method and apparatus, the relationship between measured hydraulic fluid pressure and measured resistance transmitted to the hydraulic drive unit is accounted for by correcting the measured hydraulic fluid pressure or the predetermined pressure threshold values using a predetermined formula or a look-up table. The predetermined formula or look-up table takes the measured hydraulic fluid pressure and the measured resistance, or an indicator of the resistance such as the downstream pressure of the process fluid being pumped by a process fluid pump, and produces a correction factor that can be applied to the measured hydraulic fluid pressure or to the predetermined pressure threshold values to correct for the influence of the measured resistance. In another embodiment, instead of a correction factor the predetermined formula or the look-up table can directly produce a corrected hydraulic fluid pressure value or a corrected pressure threshold value. With reference to the illustrative example shown in FIG. 2, the resistance is variable based on the process fluid pressure downstream from pump 210 so in this example, the measured process fluid pressure determined by pressure sensor 242 is used to determine a correction factor to account for the influence of the variable resistance transmitted to hydraulic drive unit 214.

The predetermined formula can be formulated to correct for more than one factor that influences the measured hydraulic fluid pressure. In preferred embodiments the predetermined formula corrects for both the influence of hydraulic fluid flow rate (which can be indicated by hydraulic pump speed or engine speed), and measured resistance transmitted to the hydraulic drive unit from the driven machinery, which in the case of a hydraulically driven process fluid pump can be indicated by process fluid pressure downstream from the pump discharge. The predetermined formula can be model-based and verified by empirically gathered data, or the formula can be empirically derived. Similarly, if a look-up table is used, it can be combined with correction factors for correcting for more than one factor that influences measured hydraulic fluid pressure. For example the look-up table can be a three-dimensional look-up table that outputs a correction factor or a corrected pressure threshold value from inputs of measured hydraulic fluid pressure, process fluid pressure downstream from the pump, which correlates to measured resistance transmitted from the machinery to the hydraulic drive unit, and hydraulic pump speed. Because of the complexity of the different influences on hydraulic fluid pressure, in some preferred embodiments the data stored and output from the look-up table can be empirically derived, in yet another embodiment, the correction factors or corrected values can be produced by a method that employs a combination of a predetermined formula and look-up tables, with the predetermined formula correcting for at least one factor that influences measured hydraulic system pressure and the look-up table correcting for at least one other factor.

Figure 7:
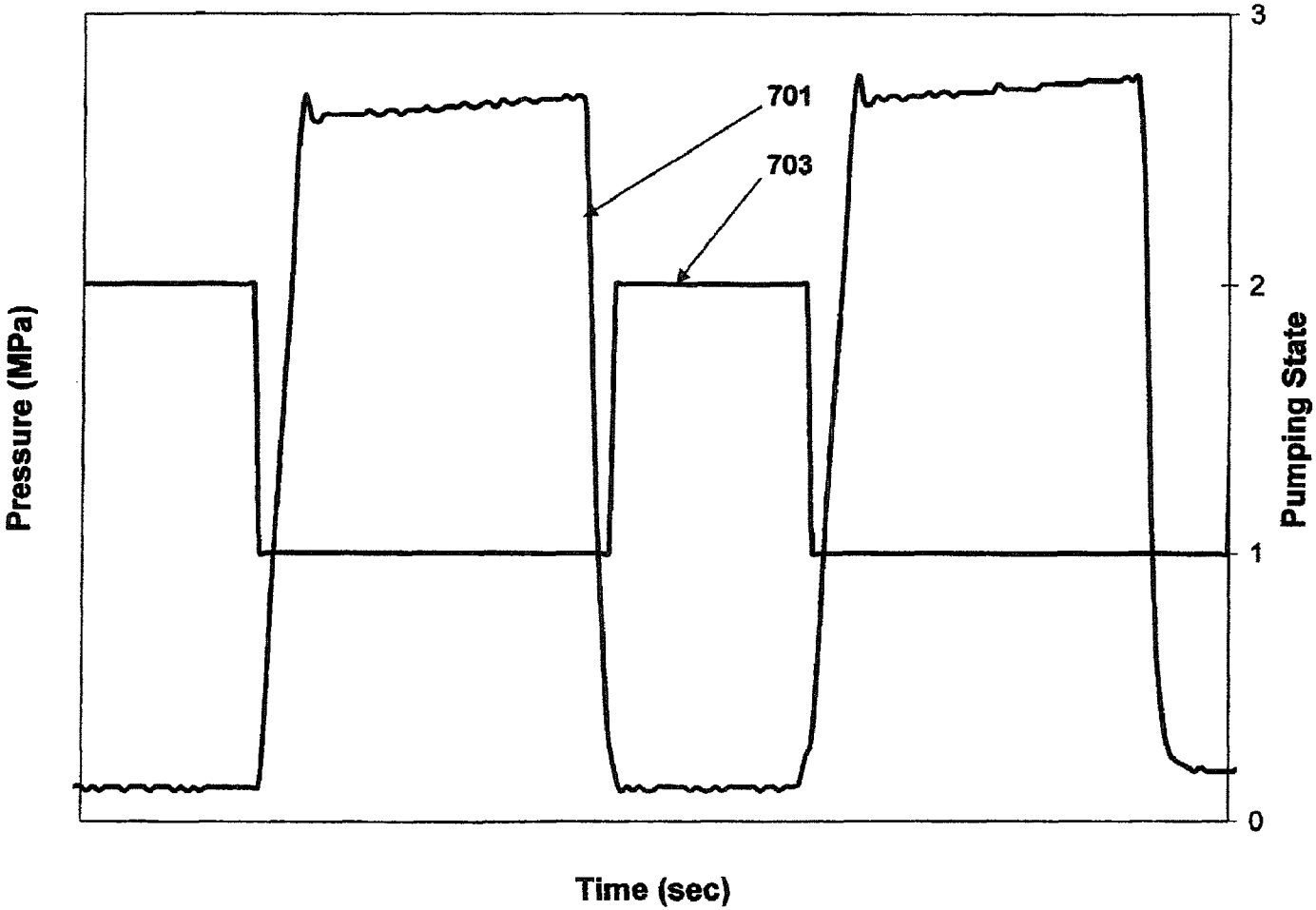
FIG. 7 is a graph that plots hydraulic system pressure and pumping state against time for the disclosed hydraulic drive system, during normal operation, employing the disclosed method to reduce time when the hydraulic piston is stationary between piston strokes.

FIG. 7 shows how the disclosed method and apparatus can be advantageous for improving efficiency of the hydraulic drive unit by reducing time that the hydraulic drive unit is idle between piston strokes. Line 701 plots hydraulic system pressure and line 703 indicates the pumping state, with a value of "one" corresponding to an extension stroke when process fluid is being pushed through the pump discharge and a value of "two" corresponding to a retraction stroke when the pump is drawing process fluid into the pump chamber. FIG. 7 plots data from an apparatus similar to the one used to collect the data in FIG. 1, with the difference being that the data associated with FIG. 7 further includes the features of the subject method and apparatus. By contrasting FIG. 7 with the prior art example in FIG. 1, it can be seen that in the same amount of time, the prior art method completes about one and a half drive cycles, whereas by employing the subject method and apparatus about two drive cycles are completed. This result is achievable by reducing the time when the shuttle valve is open and the piston is stationary, in the prior art, because a crude estimate of the timing for completing each piston stroke was used, extra time was incorporated into the estimated time for each piston stroke to ensure that the piston reached the end of each stroke because short-stroking can reduce efficiency more significantly than extra idle time at the end of each piston stroke. In the prior art example, the extra idle time corresponds to the plateaus in the hydraulic system pressure plots that are caused by the pressure drop of the hydraulic fluid flowing through the open shuttle valve and fluid passage through the hydraulic piston. In FIG. 1 these plateaus are identified by reference numbers 101A, 101B and 101A'. With the presently disclosed method and apparatus, predetermined pressure threshold values can be used by the electronic controller to detect the falling edge of pressure trace 701 leading to the plateau at the end of an extension stroke and the rising edge leading to the plateau at the end of the retraction slope, and when these predetermined thresholds are crossed the electronic controller is programmed to switch the direction of hydraulic fluid flow and reverse the direction of piston movement. With this method, the flow switching of the hydraulic fluid needs to be precise to be effective and improve efficiency by reducing idle time without prematurely reversing flow direction, which can cause short stroking. The necessary precision can be achieved by using hydraulic fluid pressure as the control parameter by applying correction factors as already discussed, resulting in an inexpensive controls-based method of flow switching for a hydraulic drive unit, in addition to using corrected pressure threshold values to adjust for the influence of factors like hydraulic fluid flow rate, and variable resistance caused by variable process fluid pressure, adjusting the predetermined pressure threshold values also helps to filter out false indications that might be caused by signal noise in the collected data. For example, if the hydraulic fluid flow rate is lower than the baseline hydraulic fluid flow rate and/or the process fluid pressure is lower than the baseline process fluid pressure, if the predetermined pressure threshold value indicating the end of an extension stroke is not lowered to a corrected pressure threshold value, the measured hydraulic system pressure could be low enough that signal noise causes the measured hydraulic system pressure to crosses the predetermined pressure threshold value, prematurely indicating the end of the piston stroke.

Figure 8:
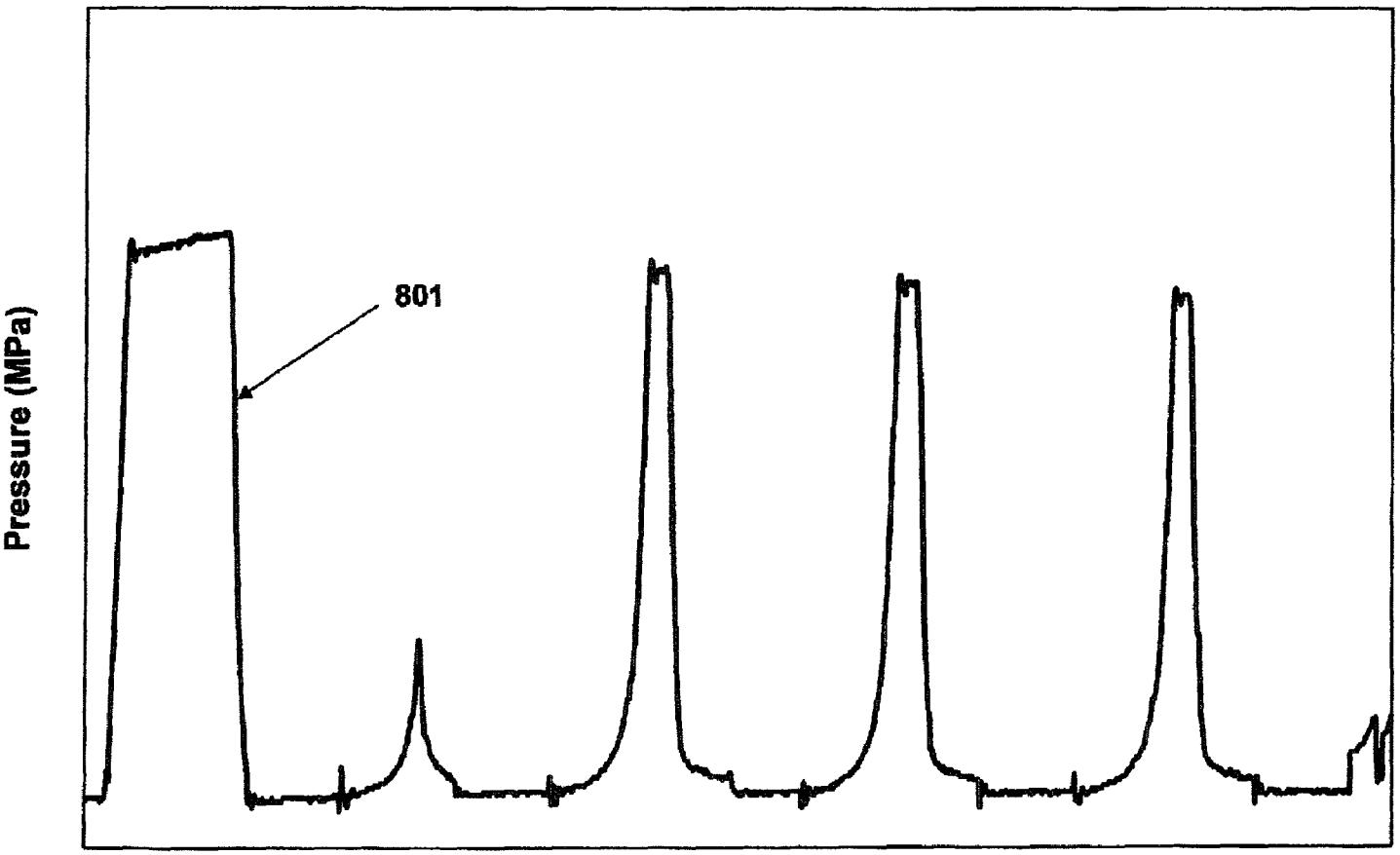
FIG. 8 is a graph that plots hydraulic system pressure against time for the disclosed hydraulic drive system, showing what the pressure trace can look like under abnormal operating conditions.
Figure 9:
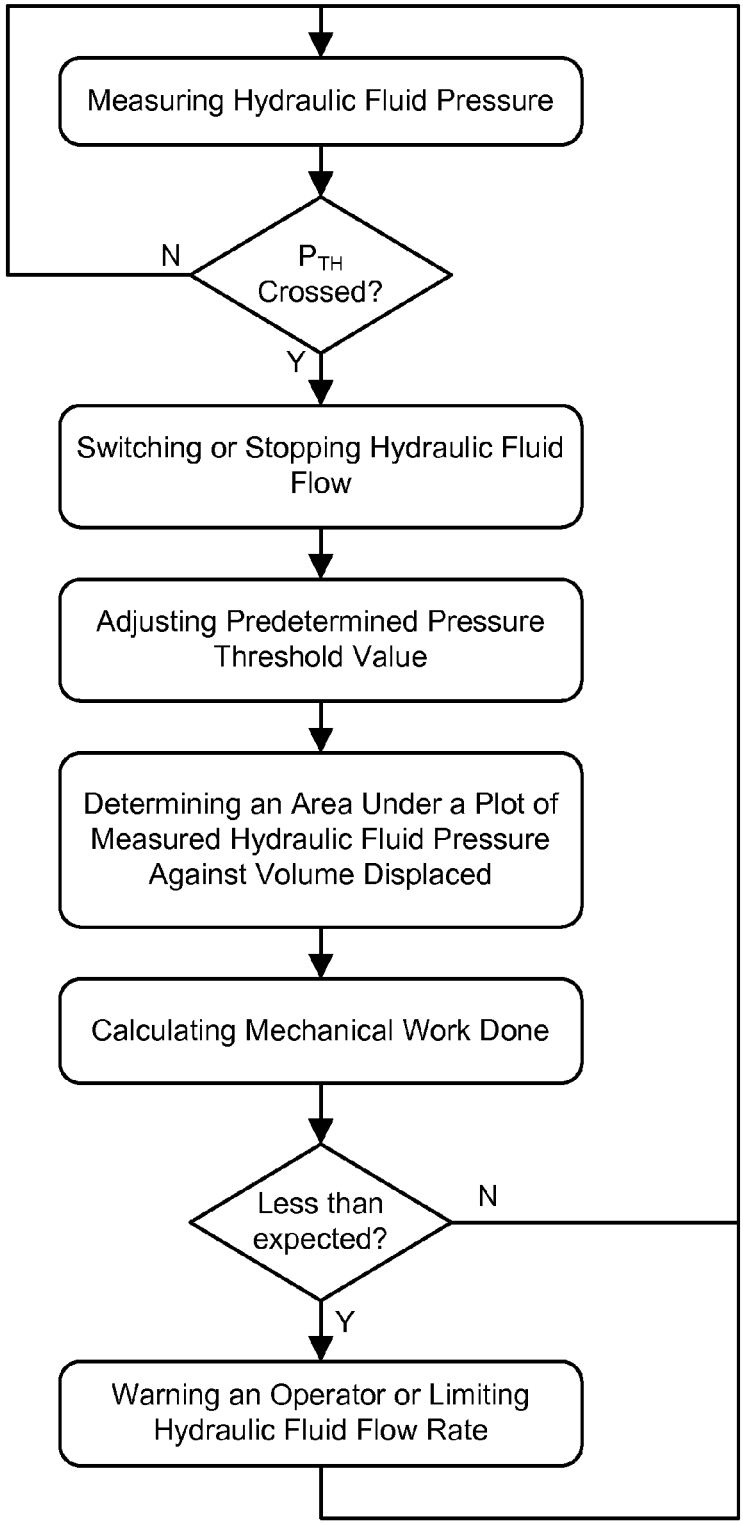
FIG. 9 is a flow diagram for a method of diagnosing and controlling a hydraulic drive system.

With reference to FIG. 8, line 801 is a plot of hydraulic system pressure against time with the data being characteristic of abnormal operating conditions. The data plotted in FIG. 8 was generated by operating an apparatus similar to the one shown in FIG. 2, when storage vessel 200 is almost empty. The data for the first pump cycle shown in FIG. 8 is characteristic of a normal pump cycle, but the second pump cycle is only a small and narrow peak, indicating that the cryogenic fluid that was drawn into pump 210 was mostly vapor. The next pump cycle shows the peak hydraulic pressure being almost normal, but the area under the plot is much smaller. For a storage vessel that is near empty the hydraulic fluid pressure trace becomes much more irregular. As shown by the third peak associated with the third pumping stroke, the measured peak hydraulic system pressure is not always a good indicator of how much mechanical work is done in each drive cycle and whether the operating conditions are normal or abnormal. That is, the first and third peaks in FIG. 8 are about the same in amplitude but the amount of mechanical work done in these two cycles is very different, demonstrating that abnormal operating conditions may not be detected if peak hydraulic fluid pressure is employed as the sole indicator of the mechanical work done by the hydraulic drive unit. Mechanical work is the amount of energy transferred by a force. The area under the plot of hydraulic system pressure against time or displaced volume is representative of the mechanical work done by the hydraulic drive unit, and this makes the calculated area a better indicator of abnormal operating conditions. If the hydraulic drive system is operated with a constant hydraulic fluid flow rate to the hydraulic drive unit, the area under the plot shown in FIG. 8 can be used to determine that there are abnormal operating conditions when the calculated area falls below a predetermined threshold area. That is, when the hydraulic fluid flow rate is constant, the calculation of area under a plot of hydraulic fluid pressure against time yields the same information about the mechanical work done by the hydraulic drive unit as the calculation of area under a plot of hydraulic fluid pressure against displaced volume. However, displaced volume is the preferred unit of measurement for calculating the area that represents the mechanical work done by the hydraulic drive unit when the hydraulic fluid flow rate is variable because displaced volume for each drive cycle is constant. For a given set of operating conditions, such as, for example, hydraulic fluid flow rate and the resistance from the driven machine, a certain predetermined amount of mechanical work is expected from the hydraulic drive unit under normal operating conditions, and when the measured mechanical work as represented by the calculated area is significantly different from the expected amount of mechanical work, this indicates that there could be abnormal operating conditions, for example if the difference from the expected amount of mechanical work continues to be greater than a predetermined margin for a predetermined number of cycles, or when there is a larger difference between the calculated and the expected amount of mechanical work. When calculating the area that represents the mechanical work done by the hydraulic drive unit, for improved accuracy it is necessary to determine accurately and with consistency the timing for when the hydraulic piston has reached the end of its stroke. In preferred embodiments this is accomplished by determining the time when the hydraulic fluid pressure declines and crosses the corrected pressure threshold value at the end of the piston stroke. Like the method that corrects the pressure threshold value for more accurately determining the end of a piston stroke, this presently disclosed method of determining mechanical work done by the hydraulic drive unit and detecting abnormal operating conditions by calculating the area under a plot of hydraulic fluid pressure also benefits from adjustments to the predetermined pressure threshold values to correct for factors such as hydraulic pump speed or process fluid pressure since these factors also influence the determination of the timing for the end of the drive cycle and the calculated area. The disclosed method also benefits from correcting the expected amount of mechanical work as a function of the same factors that are used to correct the predetermined pressure threshold values. That is, to improve the robustness of the disclosed method for determining when abnormal operating conditions exist, the expected amount of mechanical work is corrected to make adjustments as a function of at least one of the measured resistance transmitted to the hydraulic drive unit from machinery coupled to and driven by the hydraulic drive unit, hydraulic pump speed, and other parameters that correlate to these parameters.

The disclosed method is further illustrated referring back to the example of a hydraulically driven reciprocating piston pump that is used in a mobile application for removing a fluid from a storage tank. If the calculated area under a plot of hydraulic fluid pressure against displaced volume drops below a first predetermined threshold value for a predetermined number or pump cycles, this could be an indication that the storage vessel from which the process fluid is being pumped is near empty and the pump was unable to be fully charged on the pump's intake stroke. Because there can be some shifting of the fluid within the storage vessel, even when there is plenty of fluid remaining in the storage vessel there can sometimes be pump cycles when the pump was not fully charged resulting in one drive cycle that demonstrates abnormal operating conditions. For this reason, the electronic controller can be programmed to signal abnormal operating conditions only when the amount of mechanical work calculated for a drive cycle is less than the expected amount of mechanical work for a predetermined number of pump cycles. On the other hand, if the calculated mechanical work drops even lower to below a second predetermined threshold value, this could be an indication that there is a problem with the apparatus, such as a broken shaft or a severe leak in the process fluid system being supplied by the process fluid pump, and when this is detected, the electronic controller for the hydraulic drive unit can be programmed to immediately shut down the hydraulic drive unit. Conversely, the electronic controller can be further programmed to detect if the calculated area is higher than a predetermined high set point, which could be caused by an abnormally high hydraulic fluid pressure, indicating that there may be a problem with the machinery or that the machinery is trying to operate on something that is beyond its capacity. Accordingly, the electronic controller can be programmed to detect when the calculated area is higher than the predetermined high set point, in which event it shuts down the hydraulic drive unit to protect the machinery from being damaged or to allow inspection of the hydraulic drive system and driven machinery to determine if there is a problem. For these methods, which rely on predetermined pressure threshold values, to work in a robust and reliable manner, it is necessary to detect when a change in hydraulic system pressure is attributable to a change in hydraulic pump speed, a change in process fluid pressure or a change in the resistance transmitted from the hydraulically driven machinery, or an abnormal operating condition that needs to be signaled to the operator or that requires the hydraulic drive unit to be shut down.

As disclosed herein in describing the subject apparatus and method, there are many factors that can influence the measured hydraulic fluid system pressure, and if the hydraulic fluid pressure is measured remotely from the hydraulic drive unit, there are factors that can cause the measured hydraulic pressure to deviate from the hydraulic fluid pressure within the hydraulic drive unit. Some of these factors include pressure losses, friction, and leakage, all of which can vary with hydraulic fluid flow rate. Another challenge disclosed herein, associated with using measured hydraulic system pressure as a parameter for controlling hydraulic drive operation, is that hydraulic fluid system pressure is influenced significantly by the resistance transmitted to the hydraulic drive unit from the machinery driven by the hydraulic drive unit, and such resistance can change as a result of both normal and abnormal operating conditions. Because of the complexity these different factors introduce, without correcting at least one of the measured hydraulic system pressure or the predetermined threshold values that the electronic controller is programmed to use as a parameter for controlling operation of the hydraulic system, there may not be a consistent correlation between the measured hydraulic system pressure, and the operating condition that it is associated with.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A method of diagnosing and controlling a hydraulic drive system comprising:

measuring hydraulic fluid pressure in a hydraulic fluid supply conduit between a hydraulic pump and a hydraulic drive unit;

switching hydraulic fluid flow direction to said hydraulic drive unit or stopping hydraulic fluid flow to said hydraulic drive unit to end a drive cycle when measured hydraulic fluid pressure crosses a predetermined pressure threshold value;

adjusting said predetermined pressure threshold value, to a corrected pressure threshold value as a function of measured resistance transmitted to said hydraulic drive unit from machinery that is coupled to and driven by said hydraulic drive unit and hydraulic pump speed;

calculating an amount of mechanical work done by said hydraulic drive unit in said drive cycle as a function of said measured hydraulic fluid pressure and at least one of hydraulic, pump speed during said drive cycle, time to complete said drive cycle, and the volume displaced by a hydraulic piston in said hydraulic drive unit during said drive cycle; and warning an operator or limiting hydraulic fluid flow rate to said hydraulic drive unit when said calculated mechanical work for said drive cycle is less than an expected amount of mechanical work by a predetermined margin, said expected amount of mechanical work being calculated as function of an expected peak hydraulic system pressure.

2. The method of claim 1 wherein said amount of mechanical work done by said hydraulic drive unit is calculated by determining an area under a plot of measured hydraulic fluid pressure against volume displaced by a hydraulic piston in said hydraulic drive unit.

3. The method of claim 1 wherein said expected amount of mechanical work is a corrected expected amount of mechanical work, said expected amount of mechanical work is corrected as a function of at least one of:(i) measured resistance transmitted to said hydraulic drive unit from machinery that is coupled to and driven by said hydraulic drive unit; and (ii) hydraulic pump speed.

4. The method of claim 3 further comprising correcting said expected amount of mechanical work by inputting into a predetermined formula: (i) measured hydraulic fluid pressure; (ii) measured resistance transmitted from said machinery to said hydraulic drive unit; and (iii) hydraulic pump speed or measured hydraulic fluid flow rate, and using said predetermined formula to calculate a corrected expected amount of mechanical work.

5. The method of claim 4 wherein said predetermined formula is verified by comparing calculations of said corrected expected amount of mechanical work with empirically determined values representing actual mechanical work performed with the same values for resistance transmitted from said machinery to said hydraulic drive unit and hydraulic pump speed or hydraulic fluid flow rate.

6. The method of claim 4 wherein said predetermined formula is model-based and verified by comparing calculations of said corrected expected amount of mechanical work with corresponding empirically determined values for mechanical work.

7. The method of claim 3 further comprising correcting said expected amount of mechanical work by referencing a three dimensional look-up table, wherein said corrected expected amount of mechanical work is determined from: (i) measured hydraulic fluid pressure; (ii) measured resistance transmitted from said machinery to said hydraulic drive unit; and (iii) hydraulic pump speed or measured hydraulic fluid flow rate.

8. The method of claim 7 further comprising building said look-up table from empirically derived corrected expected amounts of mechanical work or empirically derived correction factors that can be applied to said expected amounts of mechanical work to determine said corrected expected amounts of mechanical work.

9. The method of claim 3 further comprising correcting said expected amount of mechanical work to determine said corrected expected amount of mechanical work from: (i) measured hydraulic fluid pressure; (ii) measured resistance transmitted from said machinery to said hydraulic drive unit; and (iii) hydraulic pump speed or measured hydraulic fluid flow rate, using a combination of correction factors determined from a look-up table and from formulas.

10. The method of claim 1 further comprising adjusting said predetermined pressure threshold value or said measured hydraulic fluid pressure to account for differences between a location where a sensor measures hydraulic fluid pressure and the hydraulic fluid pressure in the hydraulic drive unit.

11. The method of claim 1 wherein said machinery that is coupled to and driven by said hydraulic drive unit is a positive displacement pump with a reciprocating piston for pumping a process fluid from a process fluid storage vessel to a delivery conduit or accumulator vessel.

12. The method of claim 11 wherein resistance transmitted to said hydraulic drive unit from said positive displacement pump is a function of process fluid pressure measured in said delivery conduit or said accumulator vessel, and said method further comprises measuring said process fluid pressure downstream from a discharge outlet of said positive displacement pump and adjusting said predetermined pressure threshold value in direct proportion to changes in said measured process fluid pressure.

13. The method of claim 11 further comprising adjusting said corrected expected amount of mechanical work as a function of hydraulic pump speed or hydraulic, fluid flow rate.

14. The method of claim 2 further comprising stopping hydraulic fluid flow to said hydraulic drive unit when said amount of mechanical work calculated is less than said expected amount of mechanical work for a predetermined number of said drive cycles or if said amount of mechanical work calculated area is less than said expected amount of mechanical work by a predetermined amount more than said predetermined margin.

15. The method of claim 11 wherein said process fluid storage vessel is one of a plurality of process fluid storage vessels, and said method further comprises operating a hydraulic fluid flow diverting valve to divert hydraulic fluid to another hydraulic drive unit to operate another positive displacement pump associated with another process fluid storage vessel when said hydraulic drive unit is stopped.

16. The method of claim 11 wherein said amount of mechanical work done by said hydraulic drive unit is calculated by determining an area under a plot of measured hydraulic fluid pressure against volume displaced by a hydraulic piston in said hydraulic drive unit, further comprising operating a process fluid diverting valve to fluidly disconnect said positive displacement pump from said process fluid storage vessel and fluidly connect it with a second process fluid storage vessel when said calculated area is less than an expected area for a predetermined number of said drive cycles or if said calculated area is less than said expected area by a predetermined amount more than said predetermined margin.

17. The method of claim 11 wherein said hydraulic drive unit comprises a reciprocating hydraulic piston with a mechanically operable shuttle valve that automatically opens at the end of a hydraulic piston stroke to allow hydraulic fluid to flow from one side to the other side of said hydraulic piston, said method further comprising determining that said hydraulic piston has completed its stroke and switching hydraulic fluid flow direction to begin a stroke of said hydraulic piston in an opposite direction when said measured hydraulic fluid pressure decreases after said shuttle valve opens, and said measured hydraulic fluid pressure crosses said corrected pressure threshold value.

18. A hydraulic system comprising:

a hydraulic fluid reservoir in which hydraulic fluid can be stored;

a hydraulic pump for pumping hydraulic fluid from said reservoir;

a hydraulic drive unit operable to: (i)receive hydraulic fluid from said hydraulic pump; (ii) convert hydraulic fluid pressure to mechanical movements in machinery that is coupled to and driven by said hydraulic drive unit; and (iii) return said hydraulic fluid to said reservoir;

a plurality of conduits for conveying hydraulic fluid and connecting said hydraulic fluid reservoir, said hydraulic pump, and said hydraulic drive unit;

a pressure sensor associated with one of said plurality of conduits between a discharge from said hydraulic pump and an net to said hydraulic drive unit for measuring hydraulic fluid pressure; and an electronic controller programmed to:

monitor a signal representative of hydraulic fluid pressure that is measured by said pressure sensor and switch the direction of hydraulic fluid flow to and from said hydraulic drive unit or stop the flow of hydraulic fluid flow to said hydraulic drive unit to end a drive cycle as a function of measured hydraulic fluid pressure relative to a predetermined pressure threshold value;

adjust said predetermined pressure threshold value as a function of measured mechanical or fluid resistance transmitted to said hydraulic drive unit from said machinery that is driven by and coupled to said hydraulic drive unit; and hydraulic pump speed;

calculate an amount of mechanical work done by said hydraulic drive unit in said drive cycle as a function of said measured hydraulic fluid pressure and at least one of hydraulic pump speed during said drive cycle, time to complete said drive cycle, and the volume displaced by a hydraulic piston in said hydraulic drive unit during said drive cycle; and warn an operator or stop hydraulic fluid flow to said hydraulic drive unit when said calculated mechanical work for said drive cycle is less than an expected amount of mechanical work by a predetermined margin, said expected amount of mechanical work being calculated as function of an expected peak hydraulic system pressure.

19. The method of claim 18 wherein said electronic controller is programmed to calculate said amount of mechanical work done by said hydraulic drive unit by determining an area under a plot of measured hydraulic fluid pressure against volume displaced by a hydraulic piston in said hydraulic drive unit.

20. The apparatus of claim 18 wherein said electronic controller is programmed to correct said expected amount of mechanical work as a function of at least one of: (i) measured resistance transmitted to said hydraulic drive unit from machinery that is coupled to and driven by said hydraulic drive unit; and (ii) hydraulic pump speed.

21. The apparatus of claim 18 wherein said hydraulic drive unit comprises a reciprocating piston actuated by delivering said hydraulic fluid to a hydraulic cylinder on one side of said piston and draining said hydraulic fluid to said hydraulic fluid reservoir from said hydraulic cylinder on an opposite side of said piston, and said reciprocating piston comprises a shuttle valve with a valve member that is mechanically actuated to automatically move to an open position at the end of each piston stroke, whereby when said shuttle valve is open said hydraulic fluid flows from one side of said reciprocating piston to the opposite side thereof, and said valve member is movable to a closed position when hydraulic fluid flow reverses direction.

22. The apparatus of claim 21 wherein said machinery that is coupled to and driven by said hydraulic drive unit is a double-acting positive displacement pump, and said electronic controller is programmed to recognize two distinct predetermined pressure threshold values to determine when said reciprocating piston has reached the end of a piston stroke.

23. The apparatus of claim 21 wherein said machinery that is coupled to and driven by said hydraulic drive unit is a single acting positive displacement pump, and said electronic controller is programmed to recognize a first predetermined pressure threshold associated with a decrease in hydraulic fluid pressure at the end of a working piston stroke, and a second predetermined pressure threshold associated with an increase in hydraulic fluid pressure at the end of a non-working piston stroke.

24. The apparatus of dam 21 wherein said electronic controller is programmed with a predetermined formula that calculates a corrected predetermined pressure threshold value or a correction factor that is applied to said predetermined pressure threshold value to determine said corrected predetermined pressure threshold value, from data inputs of: (i) measured hydraulic fluid pressure; (ii) measured resistance transmitted from said machinery to said hydraulic drive unit; and (iii) hydraulic pump speed or measured hydraulic fluid flow rate.

25. The apparatus of claim 21 further comprising a look-up table that said electronic controller is programmed to reference to retrieve a corrected predetermined pressure threshold value or a correction factor that is applied to said predetermined pressure threshold value to determine said corrected predetermined pressure threshold value.

26. The apparatus of claim 25 wherein said look-up table is a three-dimensional lookup table with the inputs being measured hydraulic fluid pressure, measured resistance transmitted from said machinery to said hydraulic drive unit, and hydraulic pump speed.

27. The apparatus of claim 25 wherein said look-up table is empirically derived.

28. The apparatus of claim 18 wherein said machinery coupled to and driven by said hydraulic drive unit comprises a positive, displacement pump, and said apparatus further comprises a plurality of storage vessels for holding a process fluid and conduits and valves for selectively delivering process fluid from one of said storage vessels.

29. The apparatus of claim 18 wherein said hydraulic drive unit is one of a plurality of hydraulic drive units, each coupled to a positive displacement pump associated with a respective process fluid storage vessel, and conduits and valves fluidly connect said hydraulic pump to each one of said plurality of hydraulic drive units and said electronic controller is programmed to operate said valves to control the direction of hydraulic fluid flow and which one of said plurality of hydraulic drive units is operated and which ones of said plurality of hydraulic drive units are idle.

* * * * *